US006384806B1

(12) United States Patent
Matsueda et al.

(10) Patent No.: US 6,384,806 B1
(45) Date of Patent: May 7, 2002

(54) DIGITAL DRIVER CIRCUIT FOR ELECTRO-OPTICAL DEVICE AND ELECTRO-OPTICAL DEVICE HAVING THE DIGITAL DRIVER CIRCUIT

(75) Inventors: Yojiro Matsueda, Chino (JP); Michael J. Quinn, London (GB)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/271,335

(22) Filed: Mar. 18, 1999

(30) Foreign Application Priority Data

Mar. 24, 1998 (JP) ..... 10-076336

(51) Int. Cl.[7] ..... G09G 3/36
(52) U.S. Cl. ..... 345/89; 345/95; 345/691
(58) Field of Search ..... 345/147, 148, 345/89, 92, 94–95, 208–209, 99, 691–693

(56) References Cited

U.S. PATENT DOCUMENTS 5,317,401 A * 5/1994 Dupont et al. ..... 348/678
5,337,070 A * 8/1994 Kitajima et al. ..... 345/211
5,477,234 A * 12/1995 Suzuki et al. ..... 345/95
5,489,918 A * 2/1996 Moiser ..... 345/89
5,784,041 A * 7/1998 Okada et al. ..... 345/89
6,137,462 A * 10/2000 Kim ..... 345/94

FOREIGN PATENT DOCUMENTS

| | | |
|---|---|---|
| JP | A-2-295390 | 12/1990 |
| JP | A-5-100629 | 4/1993 |
| JP | A-5-100630 | 4/1993 |
| JP | A-6-180562 | 6/1994 |
| JP | A-9-54309 | 2/1997 |
| JP | A-9-244588 | 9/1997 |

* cited by examiner

*Primary Examiner*—Lun-Yi Lao
(74) *Attorney, Agent, or Firm*—Oliff & Berridge, PLC

(57) ABSTRACT

A digital driver circuit and method for driving a liquid-crystal device or other electro-optical display device. Drive performance of the electro-optical device is improved while keeping power consumption low. The digital driver circuit receives a digital image signal as an input and generates an analog drive signal. A series selection circuit selects one series from plural series of standard multi-ramp waves having voltages that change in steps with the passage of time depending on the value of a low-order bit of the digital image signal. A time selection circuit selects, on a time axis, a voltage that changes in steps in at least the selected series of standbard multi-ramp waves depending on the value of a high-order bit of the digital image signal.

6 Claims, 21 Drawing Sheets

[FIG. 6]
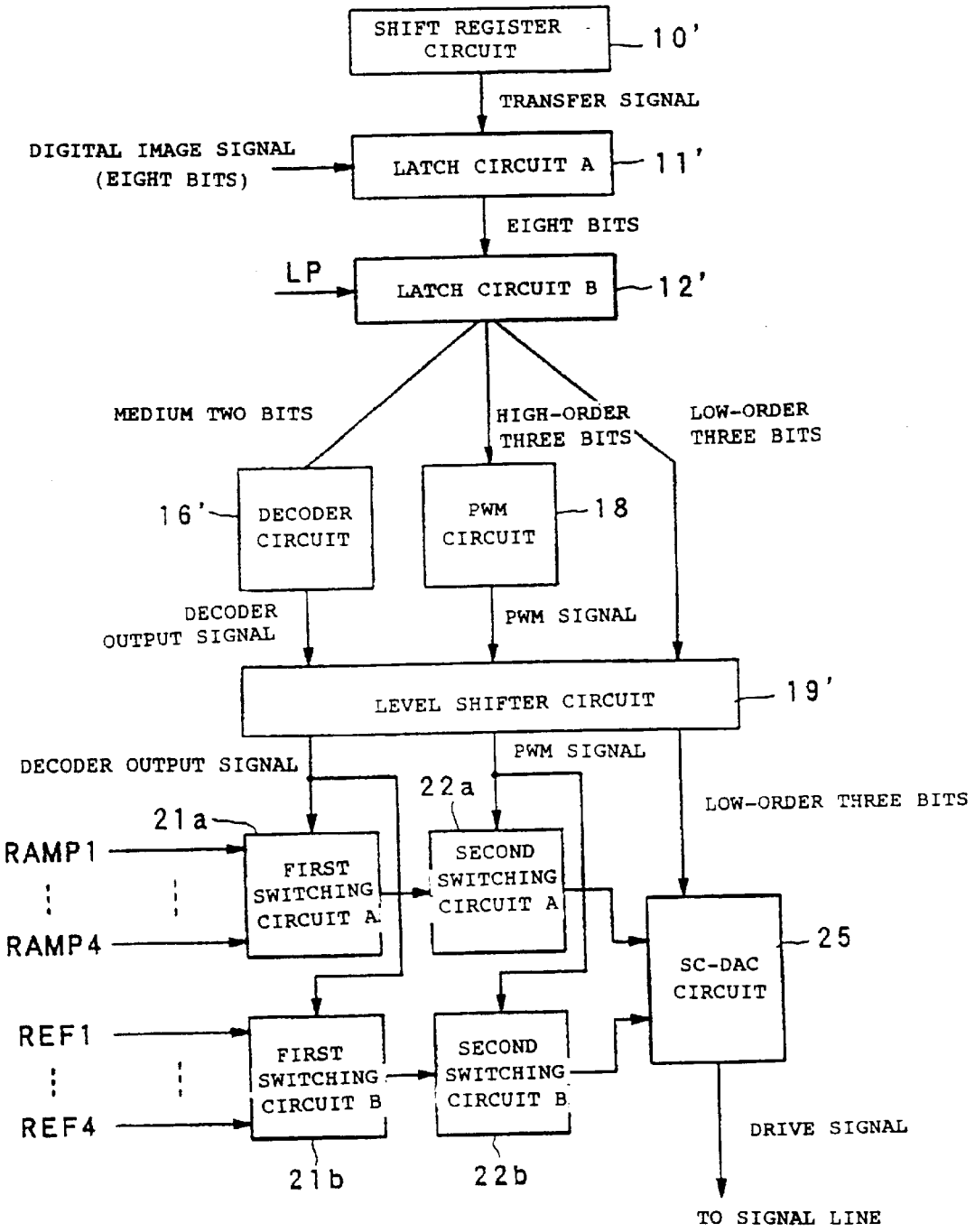

[FIG. 7]
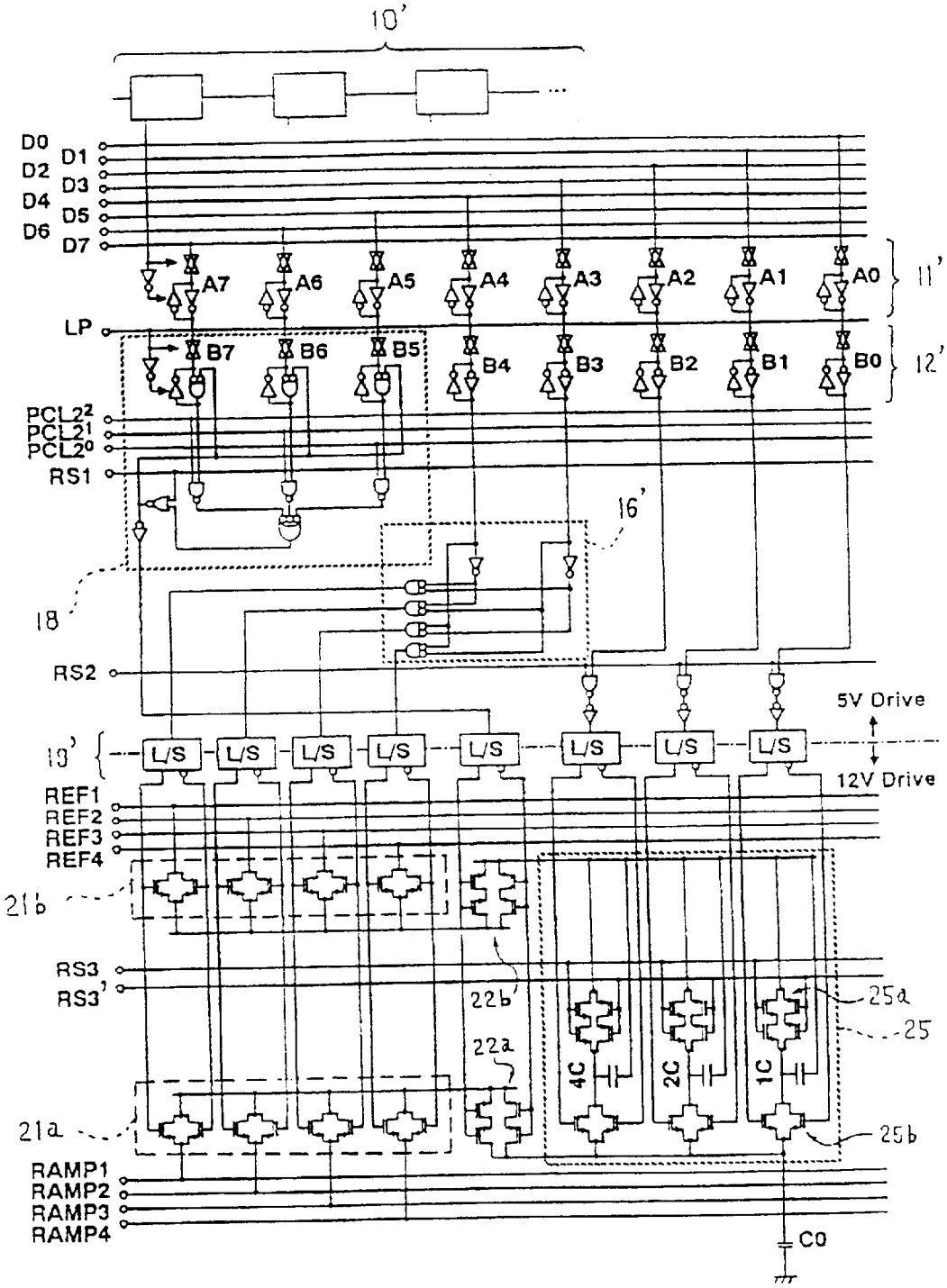

[FIG.9]
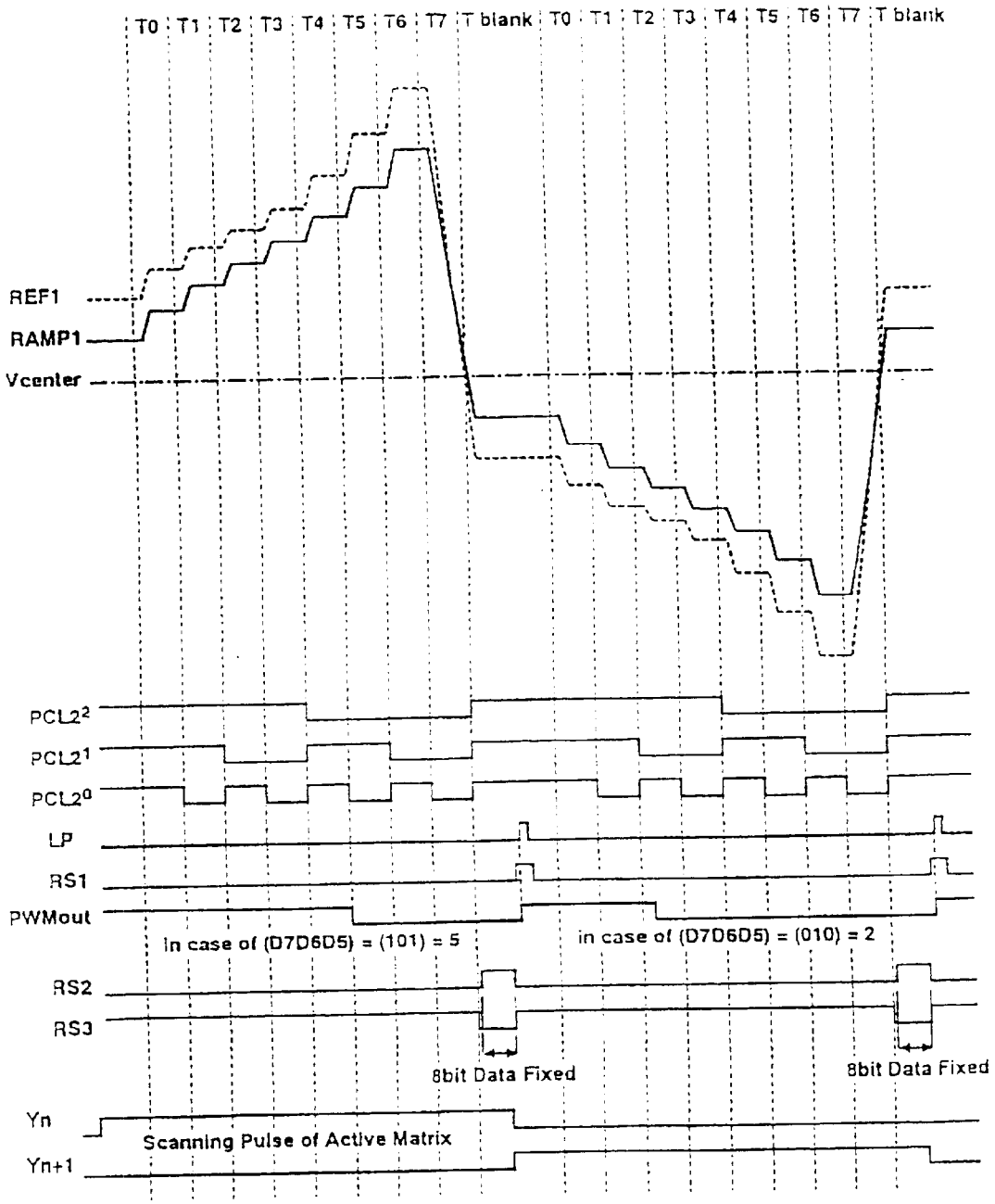

[FIG. 10]
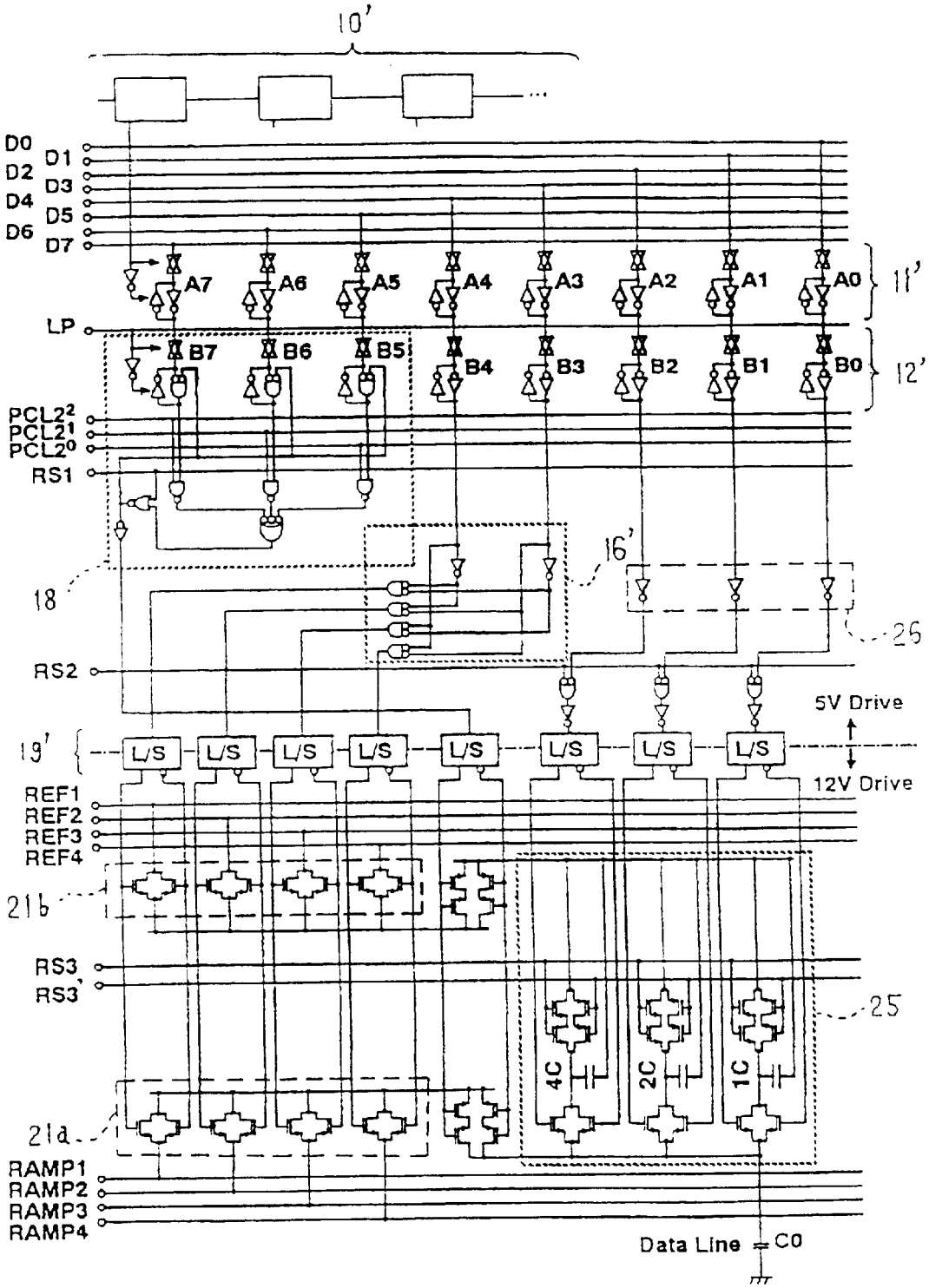

[FIG. 11]
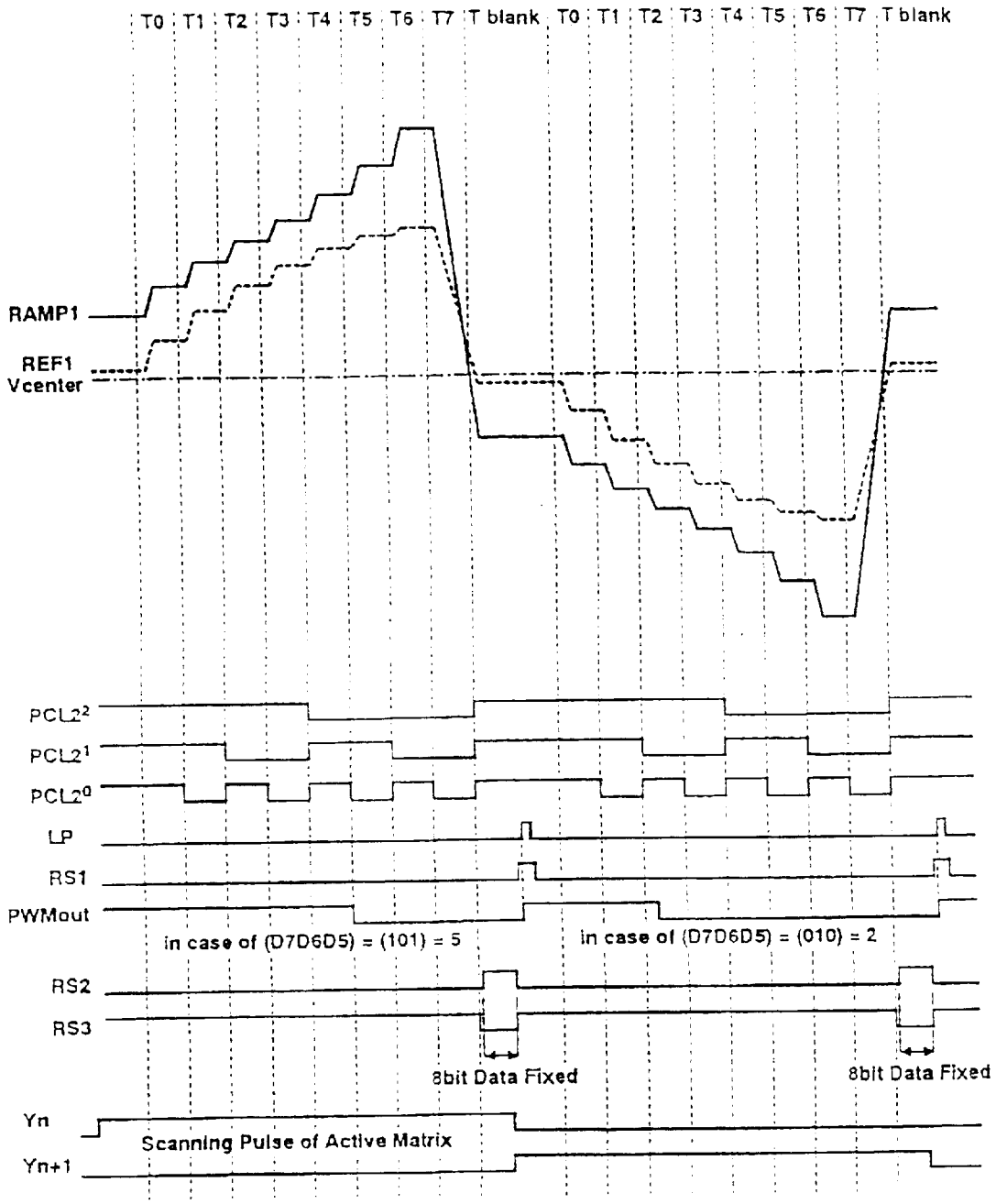

[FIG. 12]
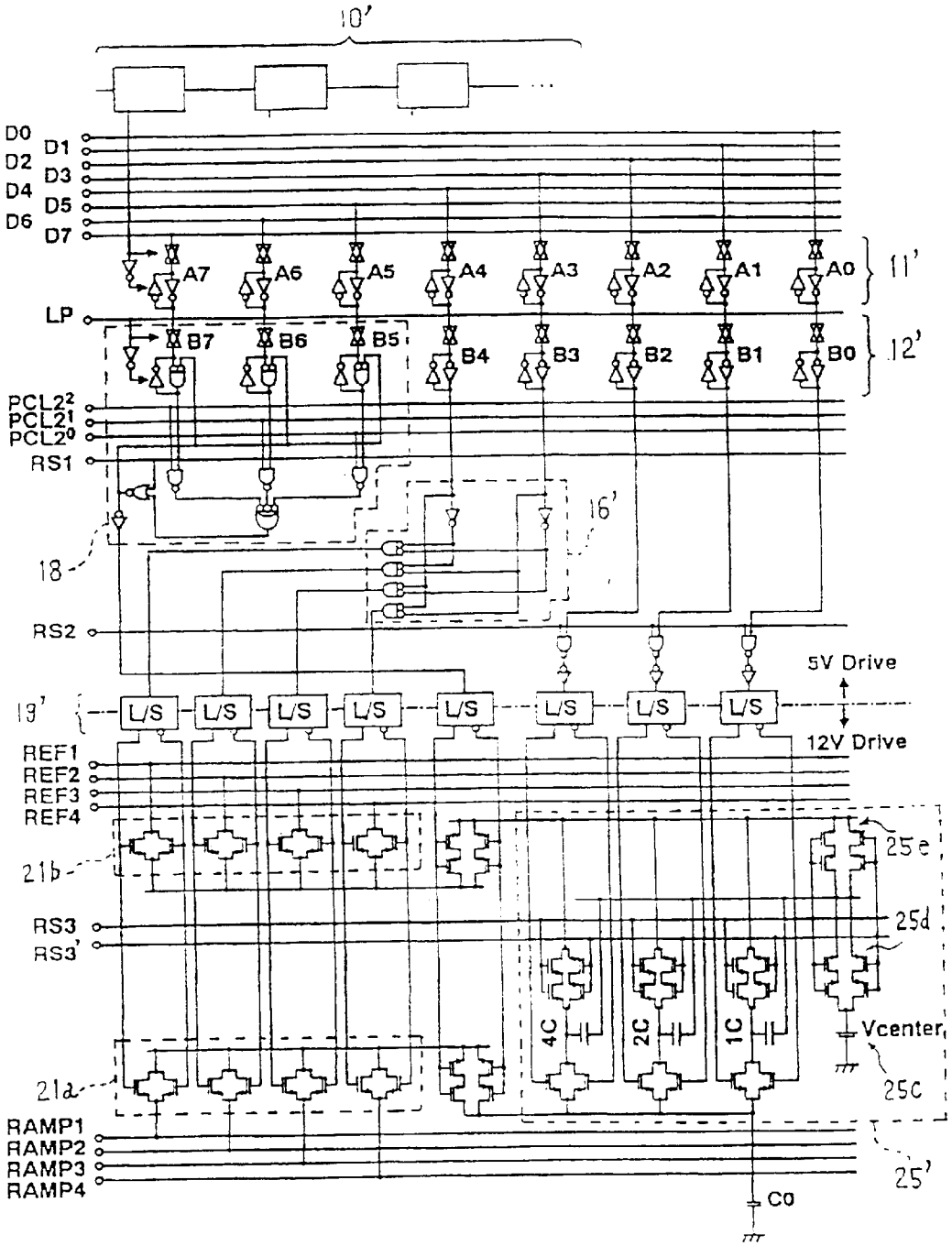

[FIG. 13]
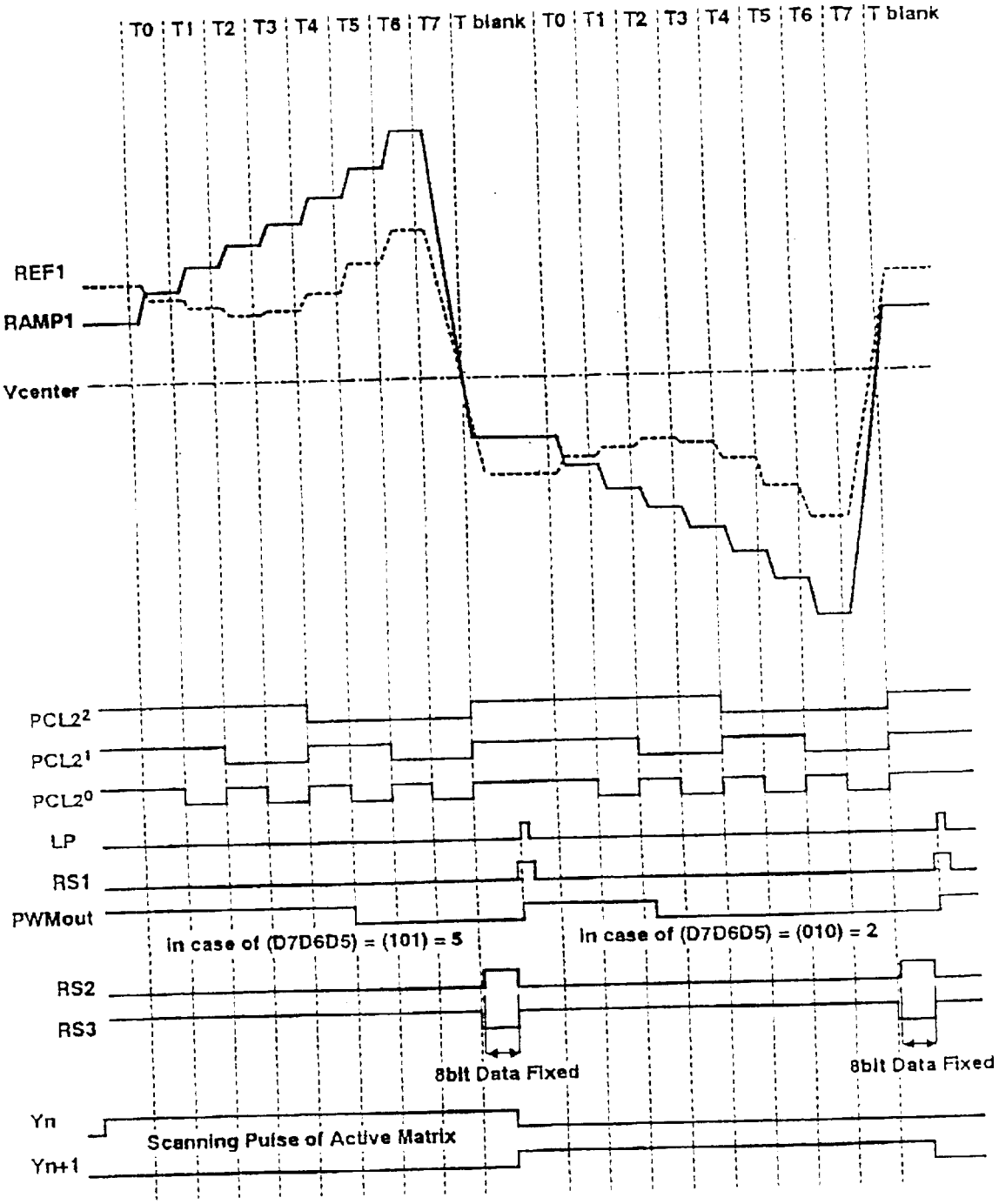

[FIG. 14]
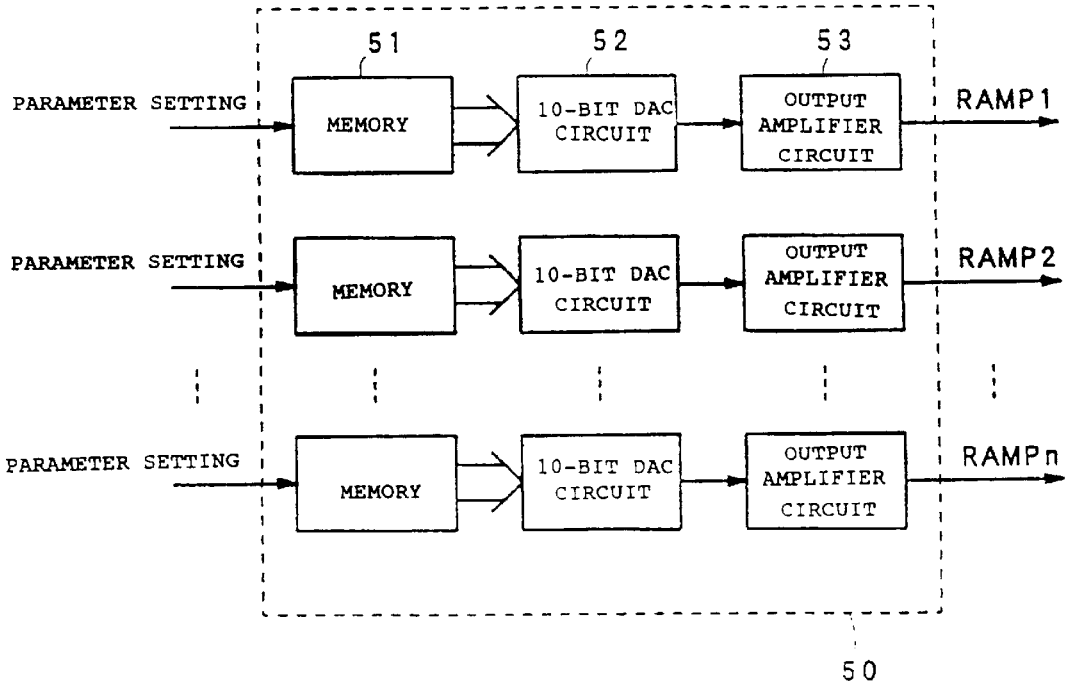
[FIG. 15]
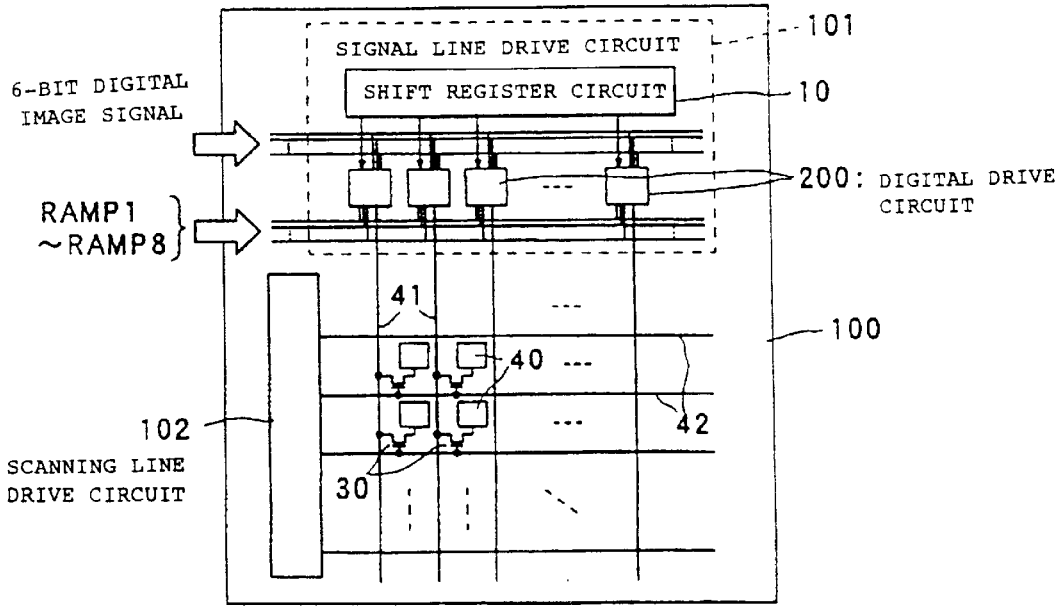

[FIG. 16]
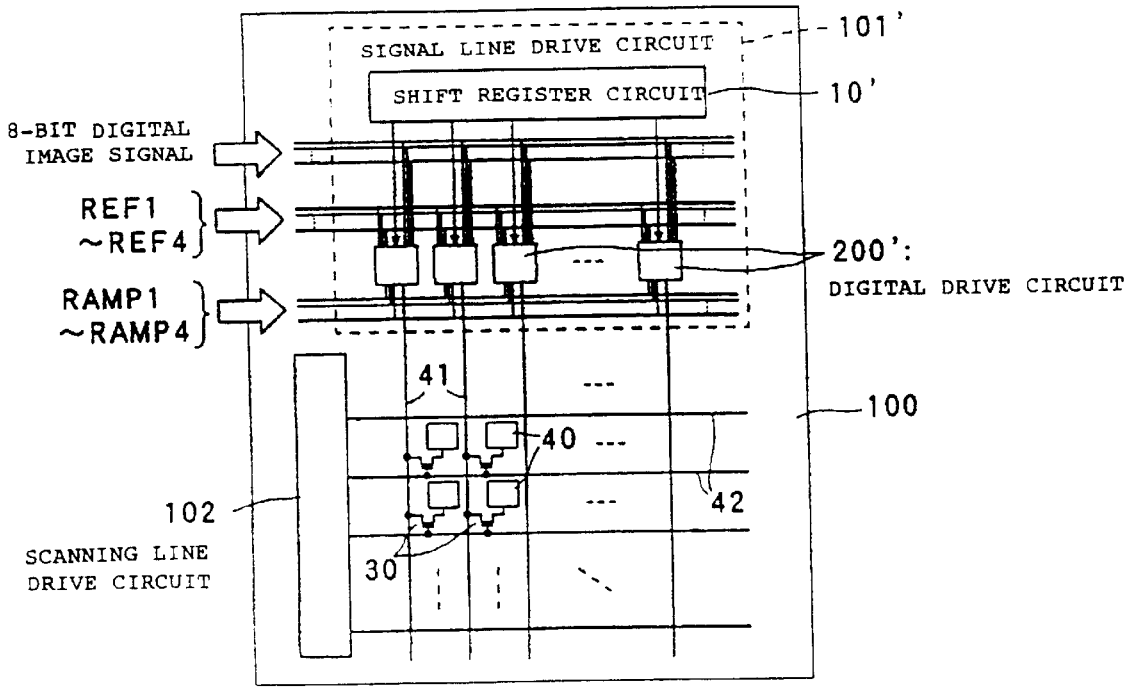

[FIG. 17]
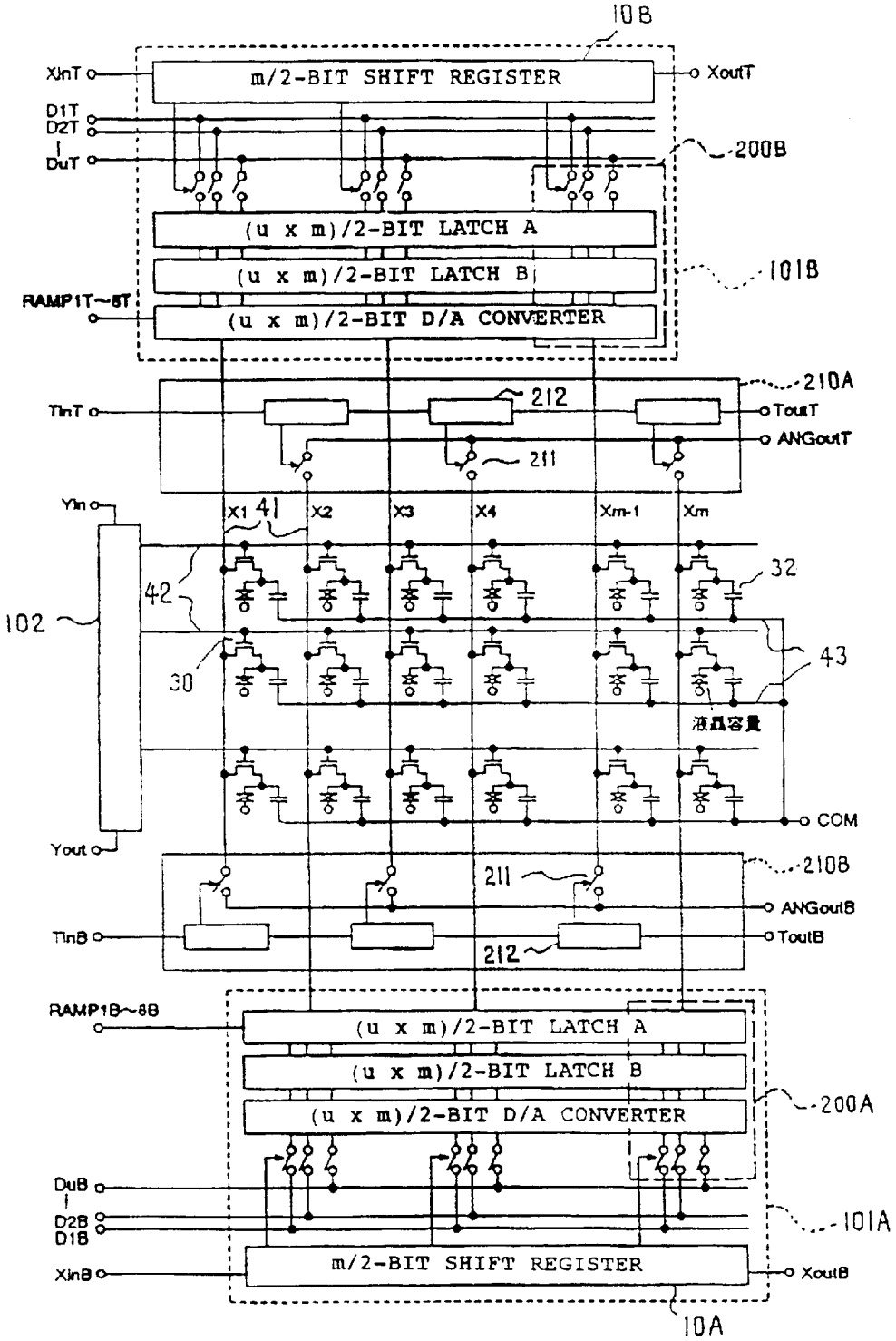

[FIG. 18]
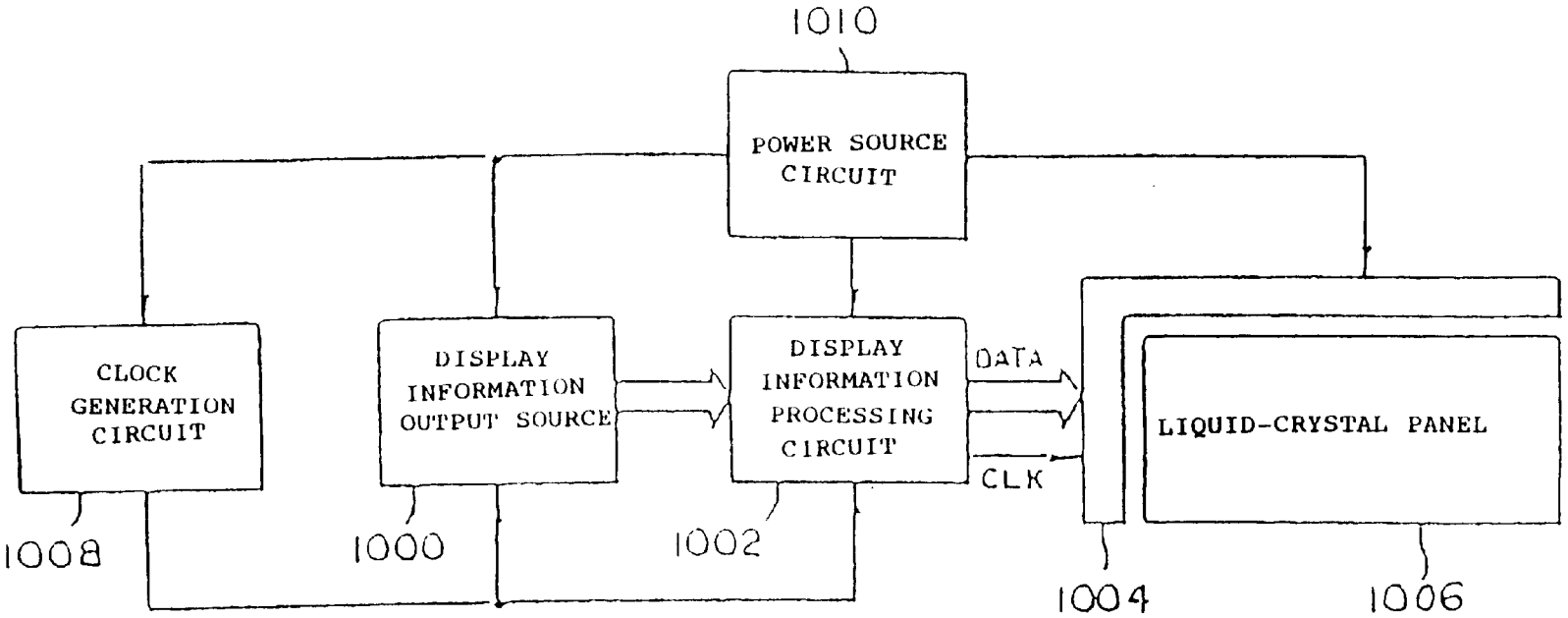

[FIG. 19]
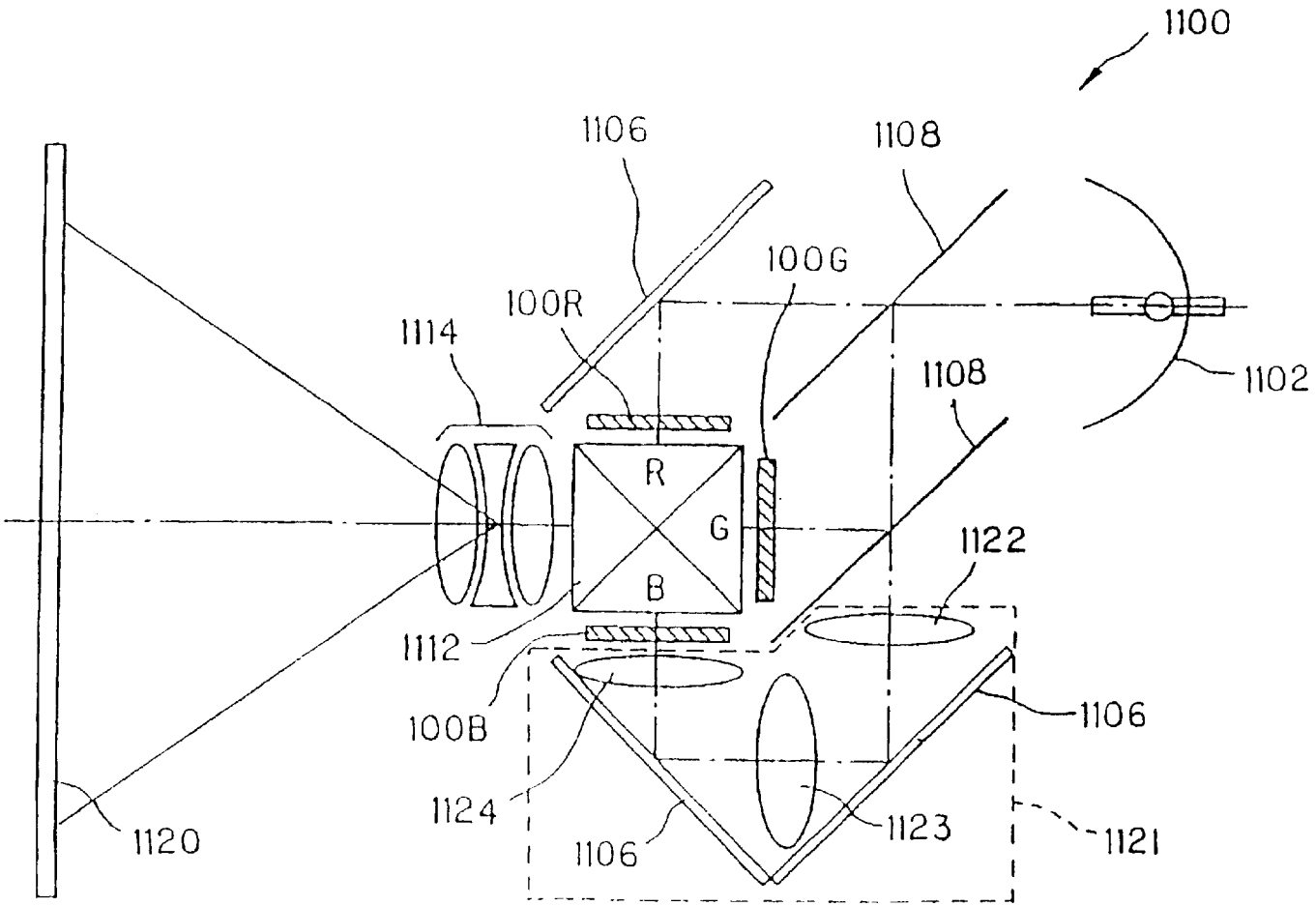

[FIG. 20]
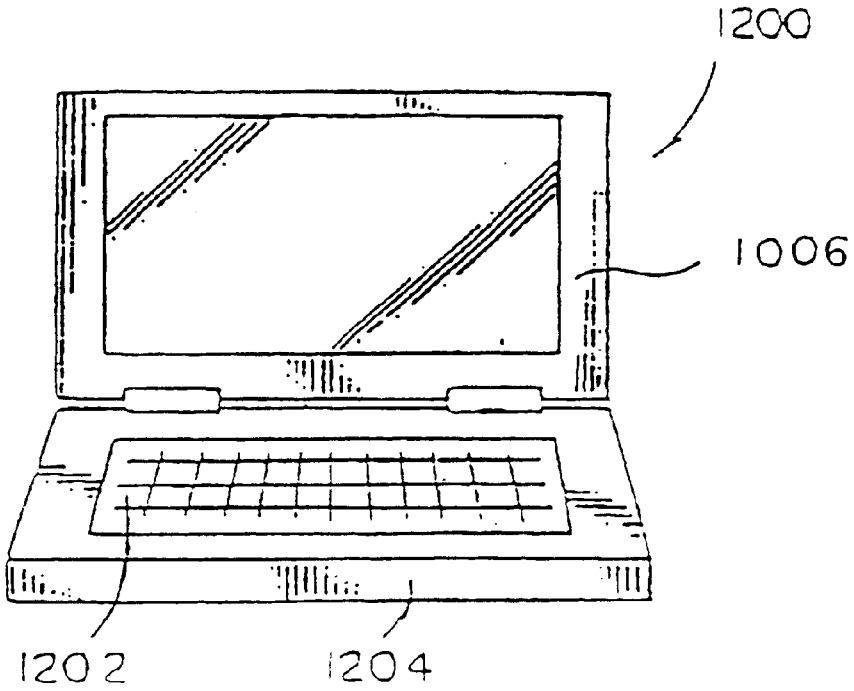

[FIG. 21]
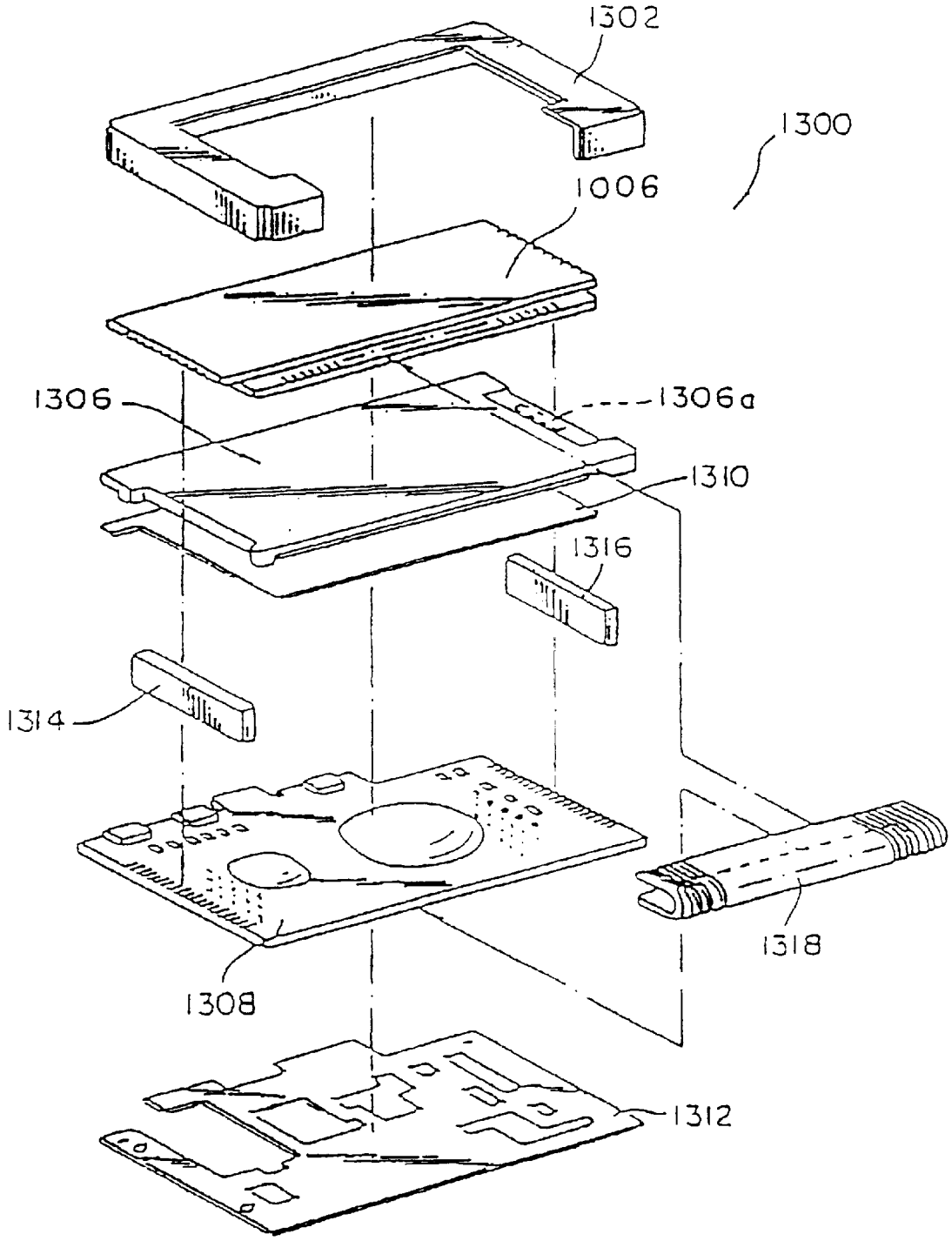

[FIG. 22]
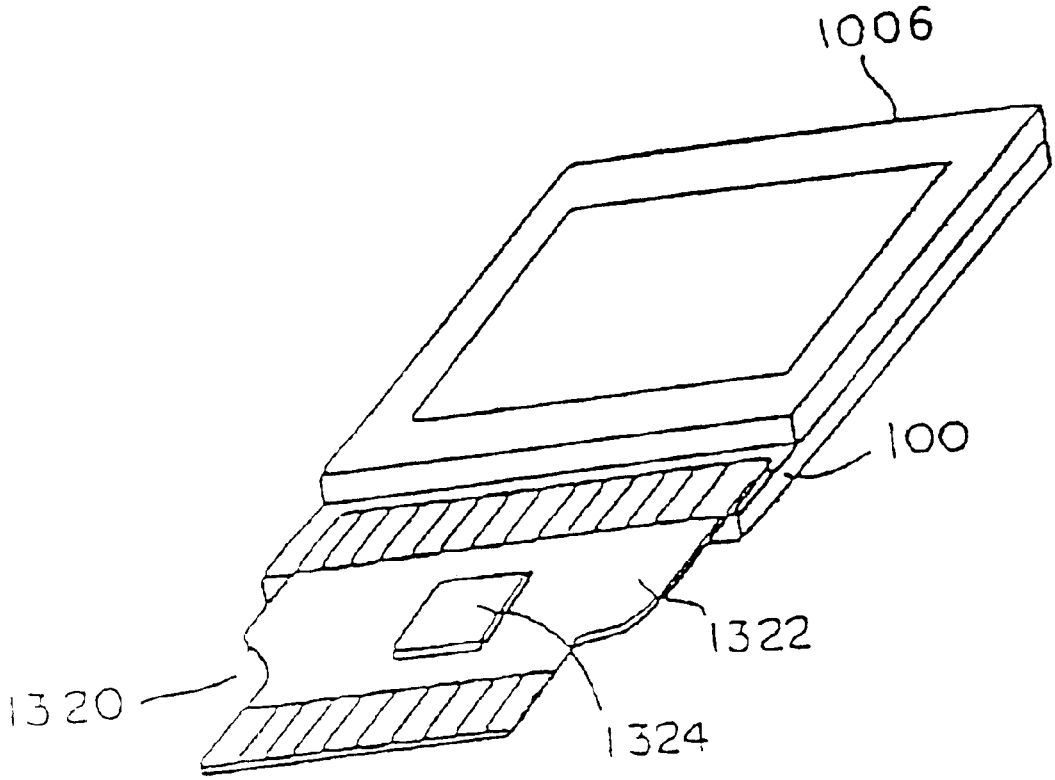

DIGITAL DRIVER CIRCUIT FOR ELECTRO-OPTICAL DEVICE AND ELECTRO-OPTICAL DEVICE HAVING THE DIGITAL DRIVER CIRCUIT

BACKGROUND OF THE INVENTION

1. Field of Invention

The present invention is directed to a digital driver circuit suitably used to drive an electro-optical device, such as a liquid-crystal device, using a TFT active matrix drive scheme, an electro-optical device having the digital driver circuit, and an electronic apparatus having the electro-optical device. More particularly, the invention is directed to a digital driver circuit or the like which receives a digital image signal as an input and uses multi-ramp waves to generate an analog drive signal.

2. Description of Related Art

Digital driver circuits which receive a digital image signal as an input and drive a display panel such as a liquid-crystal panel, to create a gradation display are known. For example, a digital driver circuit including an SC-DAC (Switched Capacitor—Digital to Analog Converter) circuit for selectively performing charge sharing or charge pumping of charges that accumulate in a plurality of capacitors having different capacities by a switching element depending on a digital image signal to generate plural voltage levels have been used. The SC-DAC circuit outputs plural voltage levels to a signal line of the display panel as drive signals corresponding to respective gradation levels, so that a gradation display can be realized. Typically, the digital driver circuit of the form including the SC-DAC circuit is externally connected to a display panel.

As another example of a digital driver circuit for driving a display panel such that a gradation display can be generated, a digital driver circuit of a form including a serial divided-voltage resistor circuit is disclosed in Japanese Unexamined Patent Publication No. 9-54309. In this form, a serial divided-voltage resistor circuit divides a plurality of reference voltages depending on a digital image signal to generate plural voltage levels, and the voltages are output to the signal line of a display panel as drive signals corresponding to respective gradation levels, so that a gradation display can be created.

In addition, as another example of a digital driver circuit for driving a display panel such that a gradation display can be generated, a digital driver circuit having a form including a PWM (pulse width modulation) circuit and using a ramp wave (saw-tooth wave) voltage is disclosed in Japanese Unexamined Patent Publication No. 9-244588. In this formation, the digital image signal is subjected to pulse width modulation by the PWM circuit to generate pulse signals having pulse widths corresponding to the digital image signals. A ramp wave is selected on a time axis depending on the pulse width to generate plural voltage levels, and the voltages are output to the signal line of the display panel as drive signals corresponding to respective gradation levels, so that a gradation display can be created.

In a digital driver circuit of this type, a general demand for a simplified circuit arrangement or for low power consumption is strong, and at the same time, a demand for drive performance to be high even with an increase of the size of a display panel. In particular, γ-correction required depending on a non-linear gradation characteristic for drive signal voltages in a display panel, such as a liquid-crystal panel, must be accurately performed by a circuit arrangement that is as simple as possible.

However, according to a digital driver circuit of a form including the conventional SC-DAC circuit, in order to make drive performance high, a large-capacity capacitor is required. For this reason, for example, the digital driver circuit is actually limited to driving a liquid-crystal panel having a size of about 5" in diagonal length. More specifically, it is difficult for the digital driver circuit to drive a display panel, such as a liquid-crystal panel, having a size larger than the above size. In particular, in a display panel having a digital driver circuit built therein, this formation in which a large capacitor must be formed on a substrate is not appropriate from the viewpoint of total circuit area or pixel pitch.

According to the conventional digital driver circuit including a serial divided-voltage resistor circuit, in order to improve drive performance, power consumption in each resistor inevitably increases with an increase in current. For this reason, the digital driver circuit cannot have a low power consumption. At the same time, a switching element, such as a thin film transistor, for performing switching control of the resistors must be increased in size to improve drive performance, and the area of the entire circuit increases. In particular, in a display panel having a digital driver circuit being built therein, a large number of resistors and large-size thin film transistors or the like must be formed on a substrate, which is not appropriate from the viewpoint of circuit area or pixel pitch.

In addition, according to the conventional digital driver circuit of a form including a PWM circuit, control of the voltage of a ramp wave with respect to time must be extremely accurately performed to correctly generate a gradation display. Therefore, an amplifier for supplying a ramp wave requires high performance, must be able to rapidly saturate a voltage for a signal line at a correct timing depending on a pulse signal, and also must create a highly accurate waveform for the ramp wave. Practically, it is very difficult to realize this type of circuit. Since a large-power ramp wave must be input at a low output impedance to improve drive performance, a problem that power consumption in the digital driver circuit is considerably high occurs. In particular, when y-correction for a digital image signal is required, problems can occur. More specifically, when as a scheme of γ-correction, any one of (i) a scheme in which the duty of a PWM base clock is changed for a gradation level depending on the characteristics of a display panel, (ii) a scheme in which a ramp wave for a time axis is changed into an S shape depending on the characteristics of a display panel, and (iii) a scheme in which a pseudo-S-shaped ramp waveform depending on the characteristics of a display panel is formed by a voltage which exactly gradually changes is selected, a voltage must be controlled at an accuracy that is higher than that used when γ-correction is not performed. Therefore, it is practically almost impossible that voltages for driving a plurality of signal lines are. assured by the digital driver circuit of this formation. For this reason, the digital driver circuit of this formation is not typically used.

The present invention has been made in consideration of the problems described above, and has as its problem to provide a digital driver circuit having relatively low power consumption and relatively high performance, an electro-optical device having the digital driver circuit, and an electronic apparatus having the electro-optical device.

SUMMARY OF THE INVENTION

The invention provides a digital driver circuit that receives a digital image signal of n (n is a natural number not less than 2) bits as an input and generates an analog drive signal corresponding to the digital image signal to output to a signal line of an electro-optical device. The digital driver circuit includes a series selection circuit that selects one series from plural series of standard multi-ramp waves having voltages which change in steps with the passage of time depending on the value of y (y is a natural number) bits of the n bits. A time selection circuit selects, on a time axis, a voltage which changes in steps in at least the selected series of standard multi-ramp waves depending on the value of x (x is a natural number) bits whose bit position is higher than that of the y bits of the n bits. The drive signal is output based on the selected voltage in the selected series.

One series is selected from the plural series of standard multi-ramp waves depending on the value of the y bits (e.g., medium or least significant three bits, four bits, or the like) of the n bits (e.g., six bits, 8 bits, 16 bits, or the like). On the other hand, the voltage which changes in steps in at least the selected series of standard multi-ramp waves is selected on the time axis depending on the value of the x bits (e.g., most significant three bits, four bits, or the like) whose bit position is higher than the y bits of the n bits. The series selection and the voltage selection may be simultaneously performed, or one of them may be performed first. When the series selection and the voltage selection are combined with each other as described above, voltages (i.e., drive signals) corresponding to the values of digital image signals are generated. For this reason, the step-form change in voltage in each of the series of standard multi-ramp waves is a relatively large change at every step, and the change in voltage at each step is maintained over a relatively long time period. Therefore, the accuracies of timings required for the series of standard multi-ramp waves become considerably low. In addition, even if the performance of the amplifier for supplying the standard multi-ramp waves is low, a time margin which is sufficient to saturate a signal line with the voltages of drive signals can be assured.

More specifically, when a drive signal is generated by using a constant voltage (saturation voltage) which is achieved after each ramp wave rises without using a voltage at the leading edge of the ramp wave, a sharp rising characteristic with respect to the corresponding ramp wave is not necessary. As a result, drive performance of the digital driver circuit can be improved by using a circuit having a relatively low through rate while the power consumption is made low, and compensation for temperature or the like can also be easily performed. Furthermore, such a circuit can be formed having a relatively small circuit area and a relatively simple structure. Therefore, the present invention is applied as a digital driver circuit, having high drive performance, for driving an electro-optical device such as a large-size display panel, or a digital driver circuit which can be built in an electro-optical device and has a small size and low power consumption.

In one aspect of the invention, a time selection circuit includes a PWM circuit for generating pulse signals having different pulse widths depending on the value of the x bits, and a first switching circuit for selecting the voltage on a time axis depending on the pulse widths. The series selection circuit includes a decoder for decoding the value of the y bits and a second switching circuit for selecting the series depending on the decoded value.

Pulse signals having different pulse widths are generated by the PWM circuit depending on the value of the x bits first, and, depending on the pulse widths, a voltage which changes in steps in the standard multi-ramp waves is selected on the time axis by the first switching circuit, e.g., a thin film transistor. On the other hand, in the series selection circuit, the value of the y bits is decoded by the decoder, and, depending on the decoded value, a series of standard multi-ramp waves is selected by the second switching circuit, e.g., a thin film transistor. Therefore, selection of standard multi-ramp waves and selection of a voltage can be performed with high reliability by using a combination of the PWM circuit, the decoder, and the switching circuit. When this arrangement is employed, high drive performance can also be realized while suppressing power consumption to a low level.

In one aspect of the invention, the selected voltage in the selected series is output as the drive signal. Thus, a selected voltage in the selected series of standard multi-ramp waves can be directly output as a drive signal. Therefore, when the number (n) of bits of a digital image signal is small, i.e., about six, a voltage is selected on the time axis depending on, e.g., three high-order bits, and a series of standard multi-ramp waves is selected depending on three low-order bits. In this manner, the digital driver circuit is especially effective from the viewpoint that a simple circuit arrangement and a simple selection scheme can be used.

In one aspect of the invention, the digital driver circuit includes a voltage change circuit that changes the selected voltage in the selected series depending on the value of z (z is a natural number) bits whose bit position is lower than that of the y bits of the n bits, and the changed voltage is output as the drive signal.

The selected voltage in the selected series of standard multi-ramp waves is changed by the voltage change circuit depending on the value of the z bits (e.g., least significant three bits, four bits, or the like) whose bit position is lower than that of the y bits. The changed voltage is output as a drive signal. Therefore, when the number (n) of bits of a digital image signal is large, i.e., about eight, a voltage is selected on the time axis depending on three high-order bits, a series of standard multi-ramp waves is selected depending on two medium bits, and the selected voltage is slightly changed depending on three low-order bits. In this manner, the digital driver circuit is effective from the viewpoint that multi-gradation can be realized with low power consumption and high drive performance.

In one aspect of the invention, the voltage change circuit includes an SC-DAC circuit for increasing and decreasing the selected voltage in the selected series depending on the value of the z bits, the series selection circuit for further selecting one series of plural series of reference multi-ramp waves for causing the SC-DAC circuit to increase and decrease the selected voltage, and the time selection circuit for further selecting, on a time axis, a voltage which changes in steps in at least the selected series of reference multi-ramp waves depending on the value of the x bits.

One series of the plural series of reference multi-ramp waves for causing the SC-DAC circuit to increase and decrease the selected voltage is further selected depending on the value of the y bits. On the other hand, in the time selection circuit, the voltage which changes in steps in at least the selected series of reference multi-ramp waves is further selected on the time axis depending on the value of the x bits. The series selection and the voltage selection may be simultaneously performed, or one of them may be performed first. In the voltage change circuit, the selected voltage in the selected series of standard multi-ramp waves is increased and decreased by the SC-DAC circuit depending on the value of the z bits. Therefore, when the number (n) of bits of a digital image signal is large, i.e., about eight, a voltage selected depending on three least significant bits is slightly changed by using the SC-DAC circuit. In this manner, the digital driver circuit is effective from the viewpoint that multi-gradation can be realized with low power consumption and high drive performance. In particular, the present invention, which performs only fine adjustment of the voltage of a drive signal by using the SC-DAC circuit, can considerably increase the limit of drive performance in comparison with the prior art in which all the gradation levels are realized by using an SC-DAC circuit. Therefore, the present invention is suitable as a digital driver circuit to be built in a display panel which generally has a limited size and has limited space for forming an excessively large capacitor therein.

In one aspect of the invention, the SC-DAC circuit performs charge sharing using a plurality of capacitors depending on the value of the z bits on the basis of the selected voltage in the selected series of standard multi-ramp waves and the selected voltage in the selected series of reference multi-ramp waves.

Charge sharing using a plurality of capacitors is performed by the SC-DAC circuit depending on the value of the z bits on the basis of the selected voltage in the selected series of standard multi-ramp waves and the selected voltage in the selected series of reference multi-ramp waves. Therefore, a voltage between the voltage of the standard multi-ramp waves and the voltage of the reference multi-ramp waves corresponding to the standard multi-ramp waves can be output by charge sharing.

In one aspect of the invention, the voltage change circuit further comprises an inversion circuit that inverts the value of the z bits to input the value to the SC-DAC circuit, and the SC-DAC circuit performs voltage subtraction by charge sharing depending on the inverted value of the z bit.

The value of the z bits is inverted by the inversion circuit first, and the inverted value of the z bits is input to the SC-DAC circuit. At this time, in the SC-DAC circuit, voltage subtraction is performed by charge sharing depending on the inverted value of the z bit. Therefore, the voltage between the voltage of standard multi-ramp waves and the voltage of reference multi-ramp waves which correspond to the standard multi-ramp waves and is lower than the voltage of the standard multi-ramp waves at the same time can be output by voltage subtraction. In this manner, when the voltage of the reference multi-ramp waves is set to be lower than that of the standard multi-ramp wave, the reference multi-ramp waves in the digital driver circuit can be easily handled, and an amplifier having low performance can be advantageously used to generate the reference multi-ramp wave.

In one aspect of the invention, the SC-DAC performs charge pumping using a plurality of capacitors depending on the value of the z bits on the basis of the selected voltage in the selected series of standard multi-ramp waves and the selected voltage in the selected series of reference multi-ramp waves.

Charge pumping using a plurality of capacitors is performed by the SC-DAC circuit depending on the value of the z bits on the basis of the selected voltage in the selected series of standard multi-ramp waves and the selected voltage in the selected series of reference multi-ramp waves. More specifically, for example, the difference between the potential of the selected series of reference multi-ramp waves is added to the potential of the selected series of standard multi-ramp waves by a selected capacitor. Therefore, a large voltage can be applied with a small capacitance by charge pumping. For this reason, the capacitors can be reduced in size, so that an area occupied by the circuit can be reduced.

In one aspect of the invention, voltages of the plural series of standard multi-ramp waves increase or decrease every predetermined time unit in a period in which the voltages steadily increase or decrease in steps. The magnitudes of the voltages of the plural series of standard multi-ramp waves in the same time unit are constant in all time units in the period, and the maximum value of the voltages of the plural series of standard multi-ramp waves in one time unit is set to be smaller than the minimum value of the voltages of the standard multi-ramp waves in another time unit following the corresponding one time unit.

In the plural series of standard multi-ramp waves, a voltage having discrete values at predetermined intervals properly appears in one of the time units of one of the plural series of standard multi-ramp waves. For this reason, when a series of standard multi-ramp waves is selected, and the voltage of the selected series is selected on a time axis, a voltage which efficiently has discrete values can be obtained. The voltage is directly output as a drive signal, or a multi-gradation-level drive signal can be output on the basis of the voltage.

In one aspect of the invention, a multi-ramp wave generation circuit generates the plural series of standard multi-ramp waves.

The plural series of standard multi-ramp waves are generated by the multi-ramp wave generation circuit arranged in the digital driver circuit. Therefore, in particular, standard multi-ramp waves are not required to be supplied from an external circuit. The digital driver circuit including an SC-DAC circuit may further include a reference multi-ramp wave generation circuit that generates plural series of reference multi-ramp waves. The digital driver circuit may also be formed such that one or both of the standard multi-ramp waves and the reference multi-ramp waves are supplied from outside of the digital driver circuit.

In one aspect of the invention, the multi-ramp wave generation circuit adjusts the voltages of the plural series of standard multi-ramp waves to perform γ-correction of the digital image signal to the electro-optical device.

The voltage of the plural series of standard multi-ramp waves are adjusted by the multi-ramp wave generation means to perform γ-correction of the digital image signal to the electro-optical device, such as a display panel. In this case, the step-form changes in voltages of the series of standard multi-ramp waves are changes which increase in steps over a relatively long time period. For this reason, when the γ-correction is to be performed, the accuracies of timings required for the standard multi-ramp waves can be low. Therefore, by using a multi-ramp wave generation circuit having a relatively low through rate, γ-correction can be performed at a high accuracy while keeping power consumption low and improving drive performance.

In one aspect of the invention, the voltages of the plural series of standard multi-ramp waves are adjusted to perform γ-correction of the digital image signal to the electro-optical device, such as a display panel. In this case, the step-form changes in voltages of the series of standard multi-ramp waves ares changes which increase every step and the voltages at each step are maintained over a relatively long period of time. For this reason, when γ-correction is to be performed, the accuracies of timings required for the standard multi-ramp waves may be low. Therefore, by using a multi-ramp wave generation circuit having a relatively low through rate, γ-correction can be performed at a high accuracy while keeping power consumption low and improving drive performance.

In one aspect of the invention, an electro-optical device includes a digital driver circuit of the invention. Since the electro-optical device includes a digital driver circuit of the present invention, a large-size electro-optical device can be realized with low power consumption.

In one aspect of the invention, the electro-optical device is a liquid-crystal device having a thin film transistor as a switching element in each pixel and using a TFT active matrix drive scheme. The series selection circuit and the series time selection circuit are thin film transistors, respectively.

Since the series selection circuit and the series time selection circuit in the digital driver circuit for driving a liquid-crystal device using the TFT active matrix drive scheme are constituted by thin film transistors, respectively, various elements and circuits can be constituted by thin film transistors in the device. For this reason, the electro-optical device is advantageous in structure. In particular, such a digital driver circuit can be formed as a relatively simple circuit formed on a TFT matrix substrate, using thin film transistors, and having a relatively small circuit area. Thus, a liquid-crystal device which has a large screen, but low power consumption and uses the TFT active matrix drive scheme can be realized. In addition, when the digital drive circuit is formed such that the voltages of standard multi-ramp waves are adjusted to perform γ-correction, a multi-gradation-level, high-quality display operation can be performed while performing γ-correction at a high accuracy.

In one aspect of the invention, an electronic apparatus, such as a television set, a satellite navigation system, an electronic organizer, or a portable telephone set which has a large size and low power consumption and includes the electro-optical device according to the invention can perform a multi-gradation-level, high-quality display operation or the like.

The invention also provides a method for driving an electro-optical device. A series of standard multi-ramp waves, having voltages that change in steps with a passage of time, is selected based on y bits of an n bit digital image signal. A voltage in the selected series of standard multi-ramp waves is then selected based on x bits of the digital image signal. The x bits of the digital image signal have a higher bit position than the y bits. An analog drive signal is output to an electro-optical device based on the selected voltage.

The operations and other aspects of the present invention will be apparent from the embodiments to be described below.

BRIEF DESCRIPTION OF THE DRAWINGS

FIG. 6 is a block diagram showing the arrangement of a digital driver circuit according to the second embodiment of the present invention.

FIG. 7 is a circuit diagram of the digital driver circuit according to the second embodiment.

FIG. 9 is a timing chart of various signals in the digital driver circuit according to the second embodiment.

FIG. 10 is a circuit diagram of a digital driver circuit according to a third embodiment of the present invention.

FIG. 11 is a timing chart of various signals in the digital driver circuit according to the third embodiment.

FIG. 12 is a circuit diagram of a digital driver circuit according to a fourth embodiment of the present invention.

FIG. 13 is a timing chart of various signals in the digital driver circuit according to the fourth embodiment.

FIG. 14 is a block diagram of a multi-ramp wave generation circuit for generating standard multi-ramp waves in the embodiments.

FIG. 15 is a block diagram of a first embodiment of a liquid-crystal device according to the present invention.

FIG. 16 is a block diagram of a second embodiment of a liquid-crystal device according to the present invention.

FIG. 17 is a block diagram of a third embodiment of a liquid-crystal device according to the present invention.

FIG. 18 is a schematic block diagram of an embodiment of an electronic apparatus according to the present invention.

FIG. 19 is a sectional view of a liquid crystal projector serving as an example of the electronic apparatus.

FIG. 20 is a front view of a personal computer serving as another example of the electronic apparatus.

FIG. 21 is an exploded perspective view of a pager serving as an example of the electronic apparatus.

FIG. 22 is a perspective view of a liquid-crystal device using a TCP and serving as an example of the electronic apparatus.

DETAILED DESCRIPTION OF PREFERRED EMBODIMENTS

Embodiments of the present invention will be described below with reference to the drawings.

Figure 1:
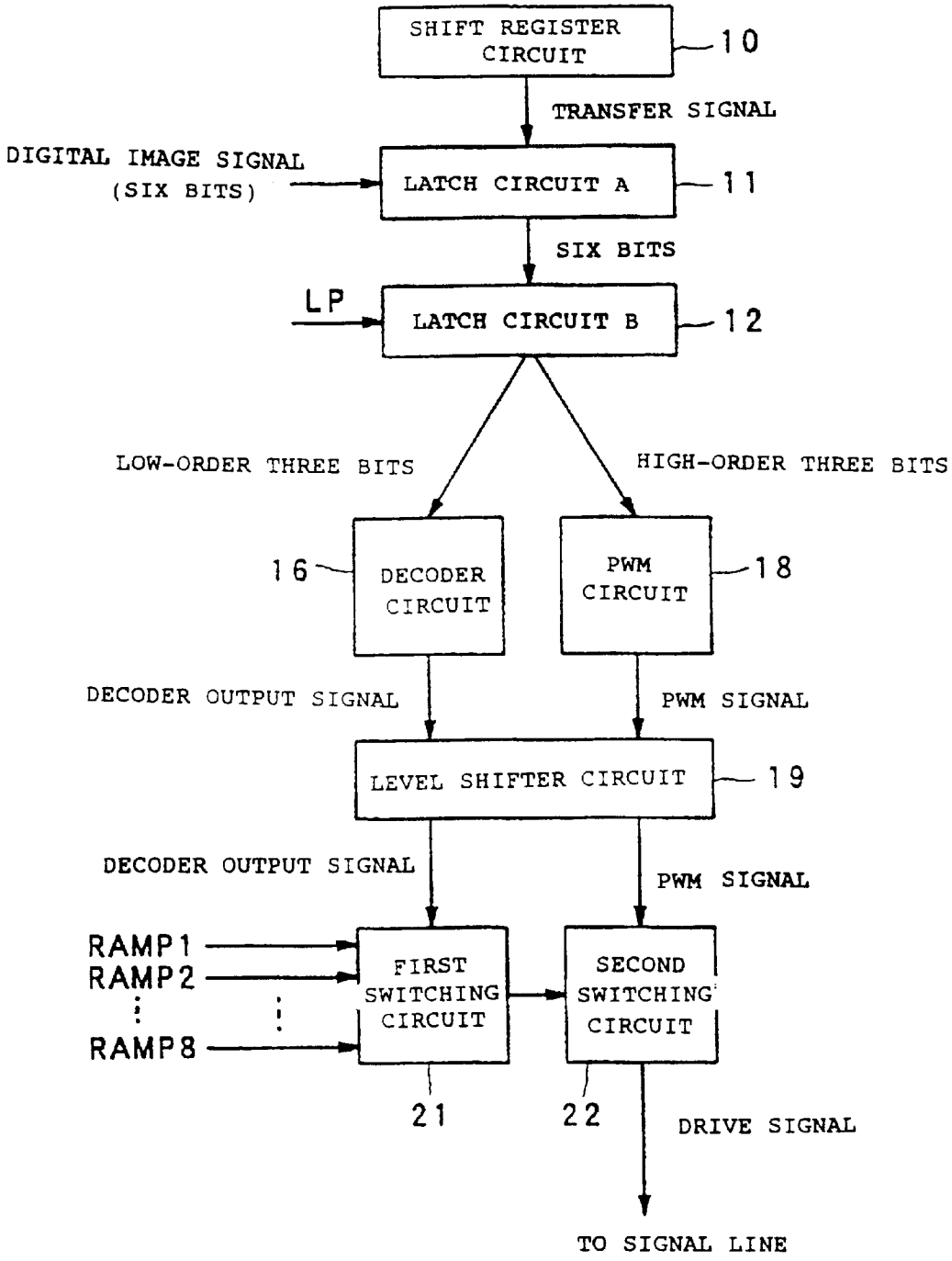
FIG. 1 is a block diagram showing the arrangement of a digital driver circuit according to a first embodiment of the present invention.
Figure 2:
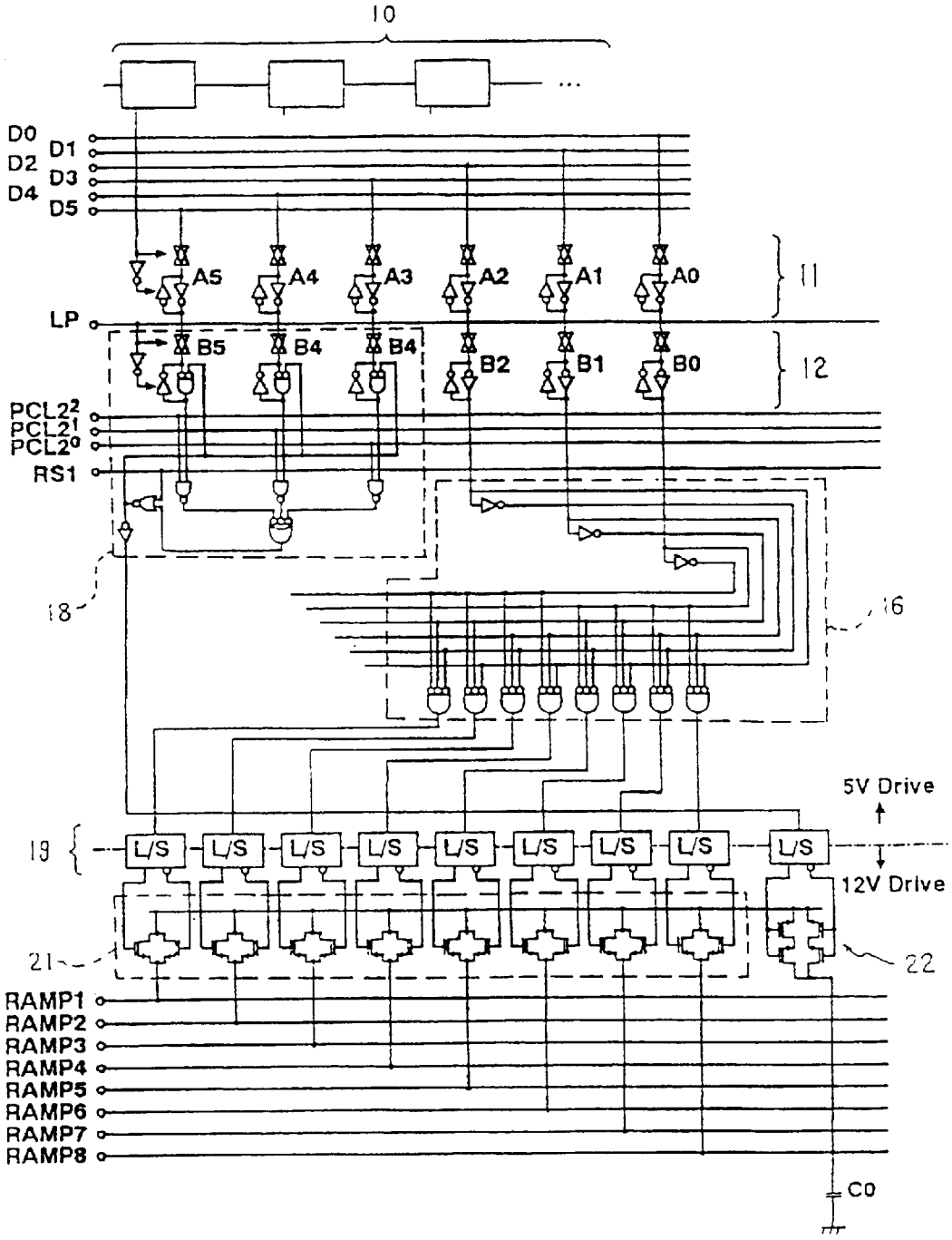
FIG. 2 is a circuit diagram of a digital driver circuit according to the first embodiment.
Figure 3:
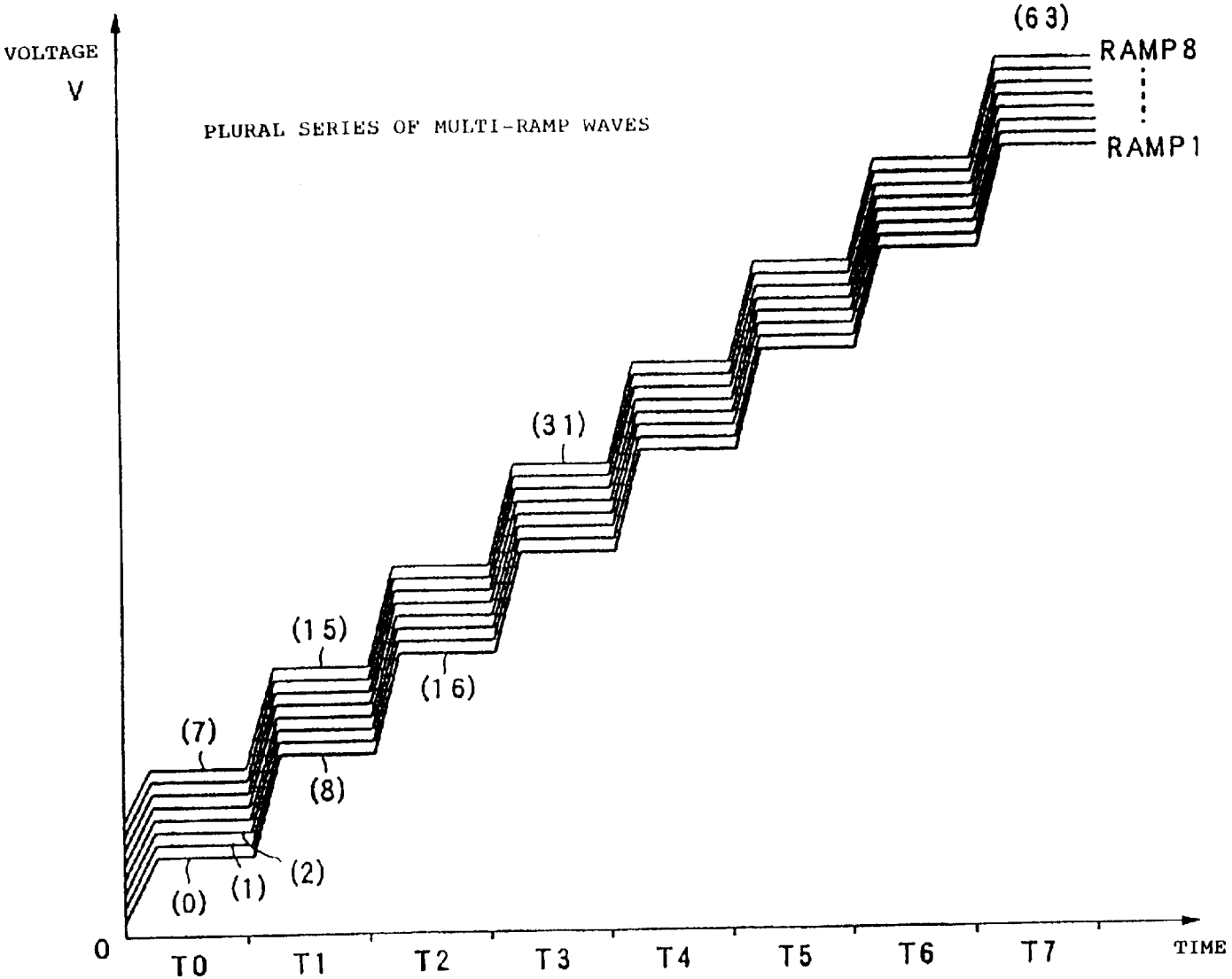
FIG. 3 is a waveform chart of plural series of standard multi-ramp waves used in the digital driver circuit according to the first embodiment.
Figure 4:
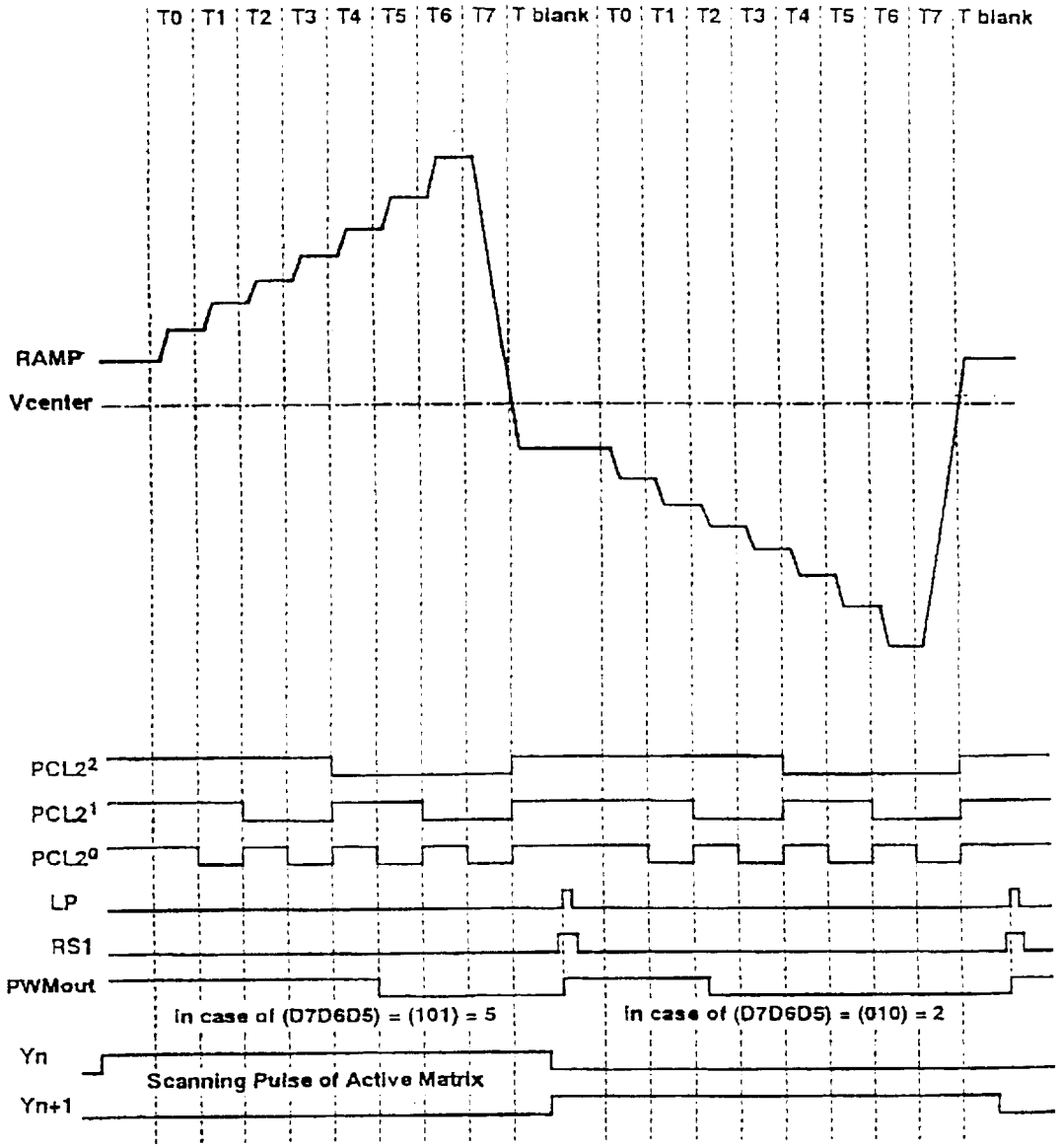
FIG. 4 is a timing chart of various signals in the digital driver circuit according to the first embodiment.
Figure 5:
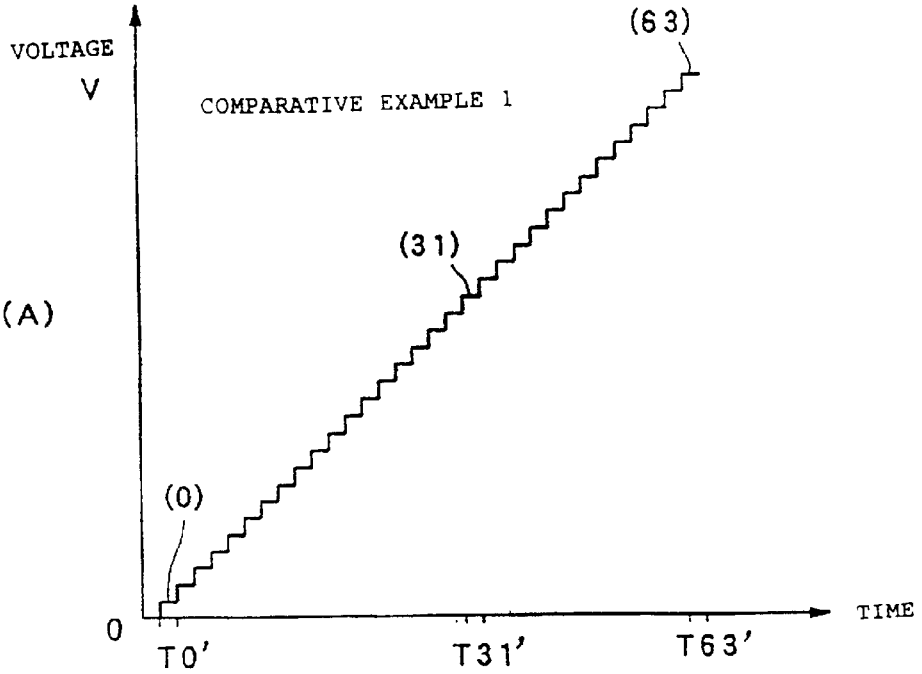
FIG. 5A is a basic waveform chart of a series of multi-ramp waves in a comparative example.
FIG. 5B is a waveform chart of one series of multi-ramp waves in a comparative example for performing γ-correction.
Figure 5:
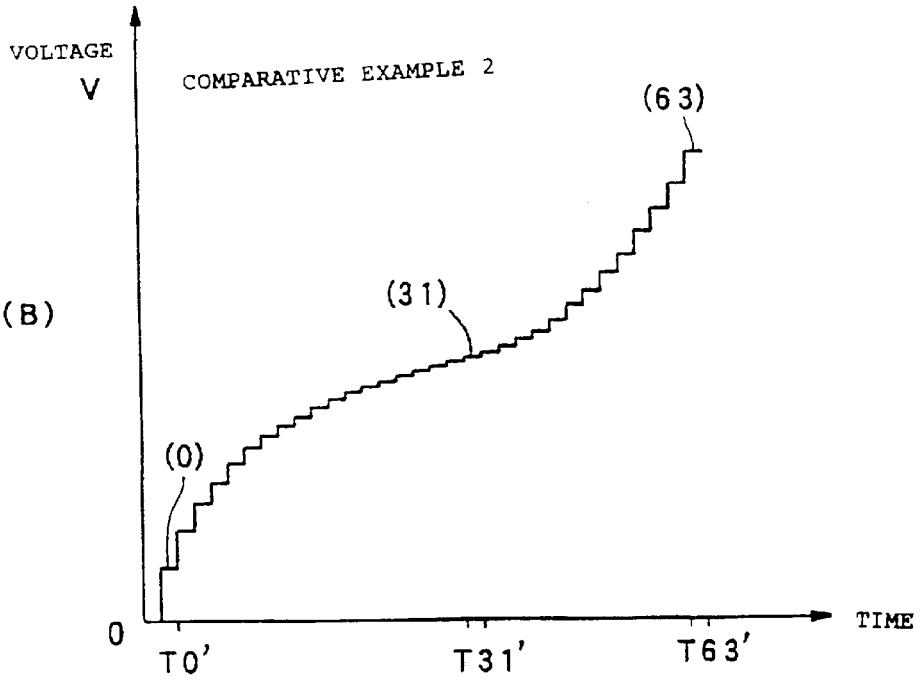

A digital driver circuit according to a first embodiment of the present invention will be described with reference to FIG. 1 to FIG. 5. FIG. 1 is a block diagram of the digital driver circuit, and FIG. 2 is a circuit diagram showing the detailed arrangement of the digital driver circuit. FIG. 3 is a waveform chart showing an example of standard multi-ramp waves used in the first embodiment, and FIG. 4 is a timing chart of various signals in the first embodiment. FIG. 5 includes waveform charts showing standard multi-ramp waves in comparative examples.

The first embodiment described below is a digital driver circuit which receives a 6-bit digital image signal as an input and generates an analog drive signal corresponding to the digital image signal for output to a signal line of an electrooptical device, e.g., a liquid-crystal panel portion in a liquid-crystal device. In particular, the first embodiment has an arrangement in which one series of eight series of standard multi-ramp waves is selected depending on three low-order bits of the digital image signal, and the voltage of the selected standard multi-ramp waves is selected on a time axis depending on three high-order bits.

Referring to FIG. 1, the digital driver circuit includes a latch circuit A 11 for latching 6-bit digital image signals by a transfer signal from a corresponding stage of a shift register circuit 10 having the number of stages corresponding to a plurality of digital driver circuits. A latch circuit B 12 latches all six bits of the digital image signal latched by the latch circuit A 11 at the timing of a latch pulse signal LP. A decoder circuit 16 decodes three low-order bits latched by the latch circuit B 12, and a PWM circuit 18 performs pulse width modulation on the basis of three high-order bits latched by the latch circuit B 12. A level shifter circuit 19 raises the voltage levels of a decoder output signal from the decoder circuit 16 and a PWM signal from the PWM circuit 18. A first switching circuit 21 selectively outputs one of standard multi-ramp waves RAMP1 to RAMP8 whose voltages change in the form of steps with the passage of time depending on the decoder output signal input from the decoder circuit 16 through the level shifter circuit 19. A second switching circuit 22 selects the voltage, changing in steps, of the standard multi-ramp waves selectively output from the first switching circuit 21 on a time axis depending on the pulse width of a PWM signal input from the PWM circuit 18 through the level shifter circuit 19 to output the voltage to a signal line of a liquid-crystal panel as a drive signal.

Referring to FIG. 2, 6-bit digital image signals D0 to D5 (it is assumed that D0 and D5 denote a low-order bit and a high-order bit, respectively) are input from an external image signal source to the digital driver circuit. PWM basic clocks $PCL2^0$, $PCL2^1$, and $PCL2^2$ are input for pulse width modulation in the PWM circuit 18 from a clock generation circuit externally connected to or incorporated in the digital driver circuit. The eight series of standard multi-ramp waves RAMP1 to RAMP8 are input from a multi-ramp generation circuit externally connected to or incorporated in the digital driver circuit.

The latch circuit A 11 comprises a plurality of latch units A0 to A5 corresponding to respective bits of the digital image signals D0 to D5 and that each include a transmission gate and an inverter. Transfer signals from the corresponding stages of the shift register circuit 10 are input to the latch units A0 to A5, respectively. The latch circuit A 11 latches the digital image signals D0 to D5 at the timings of the transfer signals.

The latch circuit B 12 comprises a plurality of latch units B0 to B5 corresponding to respective bits of the digital image signals D0 to D5 and each include a transmission gate and an inverter. A latch pulse LP is input to the latch units B0 to B5. The latch circuit B 12 is formed to latch digital image signals D0 to D5 from the latch circuit A 11 at the timing of the latch pulse signal LP.

The 3-bit decoder circuit 16 decodes three low-order bits (D0 to D2) of the digital image signals D0 to D5. The first switching circuit 21, which includes a plurality of thin film transistors, selectively supplies one of the eight series of standard multi-ramp waves RAMP1 to RAMP8 to the input terminal of the second switching circuit 22 depending on the 3-bit decoder output signals. Thus, for example, the decoder circuit 16 and the first switching circuit 21 form a series selection circuit.

The 3-bit PWM circuit 18 generates 3-bit PWM signals having different pulse widths depending on the value of high-order x bits (D3 to D5) on the basis of the PWM basic clocks $PCL2^0$, $PCL2^1$, and $PCL2^2$. The second switching circuit 22, which includes a plurality of thin film transistors, selectively supplies the voltage of the standard multi-ramp waves supplied through the first switching circuit 21 to the signal line depending on the pulse widths of the 3-bit PWM signals. Thus, for example, the PWM circuit 18 and the second switching circuit 22 form a time selection circuit. When a reset signal RS1 is input from a control circuit (not shown), the PWM circuit 18 is reset. Reference symbol C0 connected to the output of the second switching circuit 22 denotes a capacitor that includes a signal line, a pixel electrode, and the like in a liquid-crystal panel.

The level shifter circuit 19 raises the voltage levels of a PWM signal and a decoder output signal each having a power supply voltage of, e.g., 5 V to 12 V. The values of these power source voltages are not limited to 5 V or 12 V. In addition, if a switching operation in the switching circuit 21 or 22 can be sufficiently performed at, e.g., 5 V, the digital driver circuit may be formed without the level shifter circuit 19.

Concrete examples of the waveforms of the eight series of standard multi-ramp waves RAMP1 to RAMP8 are shown in FIG. 3. FIG. 3 is a graph showing the voltage values of the plural series of multi-ramp waves RAMP1 to RAMP8 to a time axis including time units T0 to T7. In FIG. 3, reference numerals (0), (1), (2), . . . , (63) denote the values (values of decimal numbers) of the digital image signals corresponding to the voltages.

As shown in FIG. 3, the voltages of the eight series of standard multi-ramp waves RAMP1 to RAMP8 increase or decrease (increase in one period shown in FIG. 3) every predetermined time unit Ti (i=0, 1, . . . , 7) in one period (T0 to T7) in which the voltages steadily increase or decrease in the form of steps. The magnitudes of the voltages of the standard multi-ramp waves RAMP1 to RAMP8 in the same time unit Ti are constant in all the time units Ti in one period (T0 to T7). More specifically, when the voltage of a multi-ramp RAMPj (j=1, 2, . . . , 8) in the time unit Ti is represented by V (j,i), V(1,i)<V(2,i)<. . . <V(8,i) is established in any time unit Ti. In addition, in a period (T0 to T7), the maximum value of the voltages of the plural series of standard multi-ramp waves in one time unit Ti, i.e., the voltage V(8,i) of the multi-ramp wave RAMP8 is set to be smaller than V(1,i+1) which is the voltage of the multi-ramp wave RAMP8. More specifically, V(8,i)<V(1,i+1) is established with respect to any time unit Ti.

Since the waveforms of the standard multi-ramp waves RAMP1 to RAMP8 are regularly ruled, voltages which have discrete values at predetermined intervals properly appear in one of the time units T1 in one of the standard multi-ramp waves RAMP1 to RAMP8. For this reason, when the standard multi-ramp waves RAMP1 to RAMP8 are selected, and the voltage of the standard multi-ramp waves are selected on a time axis, voltages which have discrete values can be efficiently obtained.

The operation of the embodiment arranged as described above will be described below with reference to the timing chart in FIG. 4. In the example in FIG. 4, it is assumed that the 6-bit value of a digital image signal is (101000) in one first-half period (left half), and is (010000) in one second-half period (right half).

Referring to FIG. 4, in one first-half period, on one side, the value of low-order bits (000) is decoded by the decoder circuit 16, and the standard multi-ramp wave RAMP1 is selected by the first switching circuit 21 depending on the decode output signal. The standard multi-ramp wave RAMP1 is supplied to the input terminal of the second switching circuit 22. On the other hand, the PWM circuit 18 generates a 3-bit PWM signal (PWMout) whose level is heightened to T4 (i.e., the fifth time unit) in correspondence with the value "5" of the three high-order bits (101) on the basis of the PWM basic clocks $PCL2^0$, $PCL2^1$, and $PCL2^2$ to supply the PWM signal to the control terminal (i.e., the gate electrode of each thin film transistor) of the second switching circuit 22. The voltage in the time unit T4 of the standard multi-ramp wave RAMP1 supplied to the input terminal is output from the second switching circuit 22 to the signal line as a drive signal voltage.

In a time unit Thlank subsequent to the first-half period, the next digital image signal is latched by the latch circuit B 12, and the PWM circuit 18 is reset by the reset signal RS1.

In the second-half period, on one side, the value of low-order bits (000) is decoded by the decoder circuit 16, and the standard multi-ramp wave RAMP1 is selected by the first switching circuit 21 depending on the decode output signal. The standard multi-ramp wave RAMP1 is supplied to the input terminal of the second switching circuit 22. On the other side, the PWM circuit 18 generates a 3-bit PWM signal whose level is heightened to Ti (i.e., the second time unit) in correspondence with the value "2"of three high-order bits (010) on the basis of the PWM basic clocks $PCL2^0$, $PCL2^1$, and $PCL2^2$ to supply the PWM signal to the control terminal of the second switching circuit 22. The voltage in the time unit T2 of the standard multi-ramp wave RAMP1 supplied to the input terminal is output from the second switching circuit 22 to the signal line as a drive signal voltage.

In a time unit Thlank subsequent to the second-half period, the next digital image signal is latched by the latch circuit B 12, and the PWM circuit 18 is reset by the reset signal RS1.

In the first embodiment, the drive signal output as described above is supplied to the signal line of a liquid-crystal panel using a TFT active matrix drive scheme. In this case, one horizontal scanning period in which a scanning signal Yn for driving a nth pixel row is supplied is caused to correspond to one period (T0 to T7) described above. In FIG. 4, the Thlank positioned between the time unit T7 in one first-half period and the time unit T0 in one second-half period corresponds to a horizontal retrace line period, and one horizontal scanning period= T0+T1+. . . +T7+ Tblank is established. As shown in FIG. 3 and FIG. 4, the standard multi-ramp waves are inverted in polarity in one period (T0 to T7) because a scanning line inversion drive scheme for inverting a drive voltage polarity every scanning line is performed in driving of the liquid-crystal panel.

As described above, according to the embodiment, selection of the standard multi-ramp waves RAMP1 to RAMP8 and selection of voltages on a time axis (i.e., selection of the time units T0 to T7) are combined with each other to generate drive signals corresponding to the values of the digital image signals D0 to D5. For this reason, step-form changes in voltage in the standard multi-ramp waves RAMP1 to RAMP8 are changes which increase in steps over a relatively long time period.

Two single series of standard multi-ramp waves which makes a gradation display possible in a digital driver circuit of a form using PWM and ramp waves is shown in FIGS. 5(A) and 5(B) as comparative examples. In the comparative example in FIG. 5(A), the voltage changes every time unit Ti' (I=0 to 63), and respective changes in voltage are slight changes. The comparative example in FIG. 5(B) shows one series of multi-ramp waves which makes γ-correction possible by changes in voltage. In this comparative example, the voltage changes every time unit Ti' (I=0 to 63), and, especially, changes in voltage near a central voltage are very slight changes.

As is apparent from comparison between FIG. 3 and FIGS. 5(A) and 5(B), if drive signals having the same number of gradation levels are obtained, step-form changes in voltage in the standard multi-ramp waves RAMP1 to RAMP8 according to the embodiment are changes which increase in steps over a relatively long time period in comparison with the standard multi-ramp waves in the comparative example. For example, it is assumed that the number of series is represented by M (M: natural number) and that a change in voltage for each step in case of one series of standard multi-ramp waves in FIGS. 5(A) and 5(B) is represented by ΔV. In FIG. 3, a change in voltage for each step required to realize gradation changes having the same fineness is large, i.e., ΔV×M. In addition, it is assumed that a time of one step in case of one series of standard multi-ramp waves in FIGS. 5(A) and 5(B) is represented by ΔT. In FIG. 3, a time of one step required to realize gradation changes having the same fineness is long, i.e., ΔT×M.

In addition, when γ-correction is performed by a change in voltage of a multi-ramp wave, only the intervals between the plural series of multi-ramp waves RAMP1 to RAMP8 shown in FIG. 3 and the angles of the multi-ramp waves RAMP1 to RAMP8 slightly change. In comparison with the comparative example shown in FIG. 5(B), if drive signals having the same number of gradation levels are obtained, a change in voltage for each step can be increased, and a long time can be set for each step.

Therefore, according to the embodiment, the accuracies of timings required for the standard multi-ramp waves RAMP1 to RAMP8 is considerably lower. In addition, even if the performance of an amplifier for supplying the standard multi-ramp waves RAMP1 to RAMP8 is low, a time margin which is sufficient to saturate the capacitor C0 constituted by a signal line or the like of the display panel with the voltages of drive signals can be assured. More specifically, since drive signals are generated by using constant voltages (saturation voltages) which are achieved after ramp waves rise without using voltages included in the standard multi-ramp waves RAMP1 to RAMP8 and generated at the leading edges of the ramp waves, sharp rising characteristics with respect to the corresponding ramp waves are not necessary. This is considerably advantageous when plural signal lines of a large number of signal lines arranged for each pixel column of a display panel or all the signal lines are simultaneously driven.

As a result, according to the digital driver circuit according to the embodiment, drive performance can be improved by using a circuit having a relatively low through rate while the power consumption is made low, and compensation for temperature or the like can also be easily performed. Furthermore, such a circuit can be formed having a relatively small circuit area and a relatively simple structure. Therefore, the embodiment is applied as a digital driver circuit, having high drive performance, for driving a large-size display panel, or a digital driver circuit which can be built in a liquid-crystal panel and has a small size and low power consumption.

In the first embodiment, in particular, a selected voltage in selected standard multi-ramp waves is directly output as a drive signal. For this reason, when the number of bits of a digital image signal is small, i.e., about six, the digital drive circuit is especially advantageous from the viewpoint that a circuit arrangement and a selection scheme may be relatively simple. In addition, not only a voltage-drive type electro-optical device such as a liquid-crystal panel can be driven by a voltage signal, but also, by making current supply performance for standard multi-ramp waves, a current-drive type electro-optical device such as an EL (electroluminescence) panel can be driven.

Figure 8B:
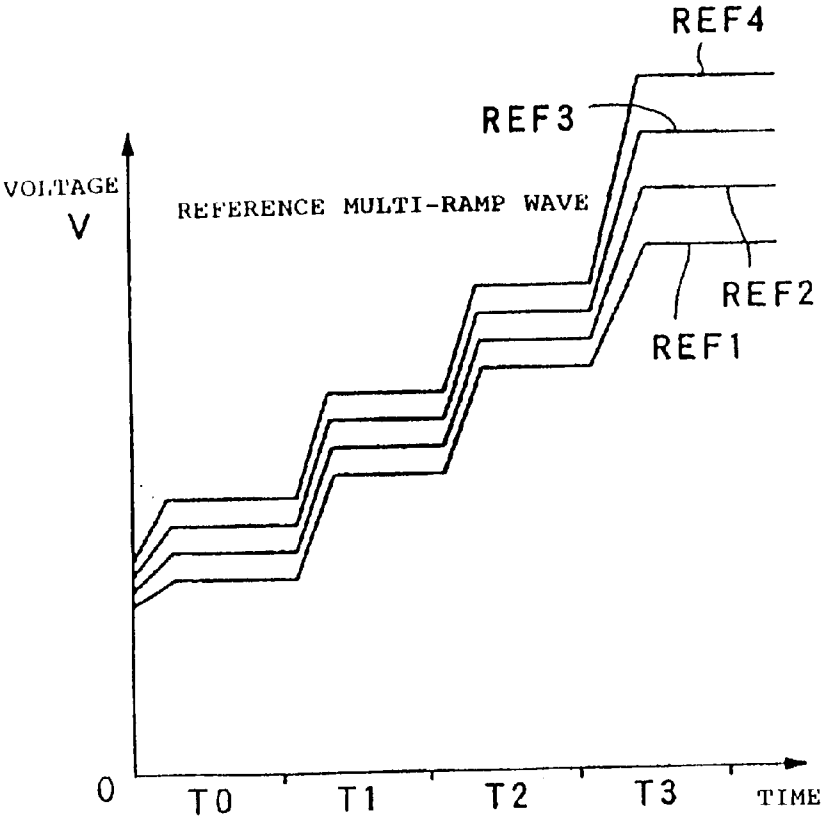
FIG. 8B is a waveform chart of reference multi-ramp waves.
Figure 8A:
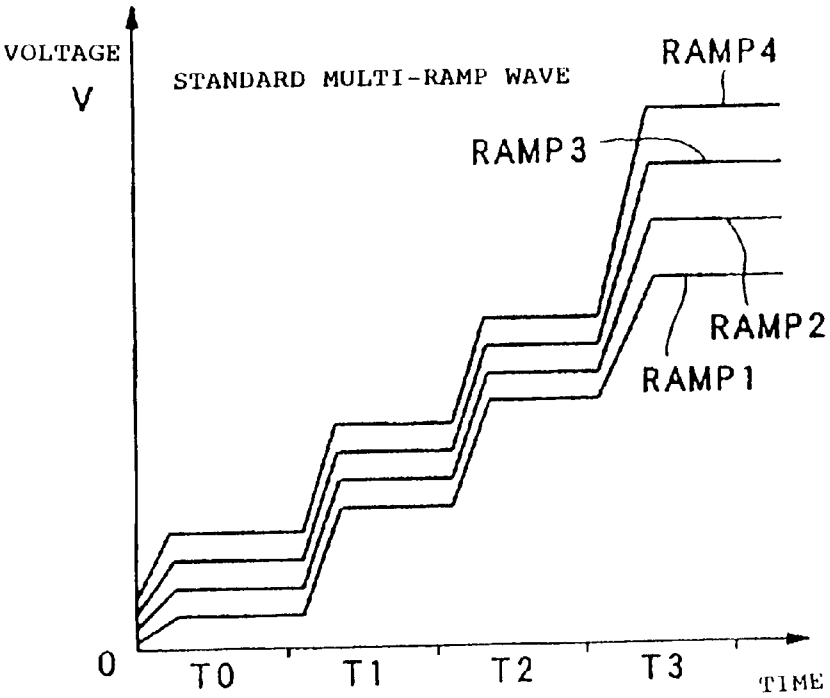
FIG. 8A is a waveform chart of plural series of standard multi-ramp waves used in the digital driver circuit according to the second embodiment.

A digital drive circuit according to the second embodiment of the present invention will be described below with reference to FIG. 6 to FIG. 9. FIG. 6 is a block diagram of a digital driver circuit according to the second embodiment, and FIG. 7 is a circuit diagram showing a more detailed arrangement of the digital driver circuit. FIG. 8 includes waveform charts showing standard multi-ramp waves and reference multi-ramp waves used in the second embodiment, and FIG. 9 is a timing chart of various signals in the second embodiment. The same reference numerals in the first embodiment shown in FIGS. 1, 2, and 4 denote the same elements and signals in FIG. 6 to FIG. 9, and a description thereof is omitted.

In the second embodiment to be described below, a digital driver circuit receives 8-bit digital image signals as inputs and generates analog drive signals corresponding to the digital image signals to be output to a signal line of an electrooptical device, e.g., a liquid crystal panel. One series of four series of standard multi-ramp waves is selected depending on two medium bits of the digital image signals, and the voltage of the selected standard multi-ramp wave is selected on a time axis depending on three high-order bits to obtain a voltage having rough gradation. Thereafter, on the basis of the voltage having rough gradation, a voltage having fine gradation is obtained by an SC-DAC circuit.

Referring to FIG. 6, the digital driver circuit according to the second embodiment includes a latch circuit A 11' for latching 8-bit digital image signals by a transfer signal from a corresponding stage of a shift register circuit 10' having a number of stages corresponding to a plurality of digital driver circuits. A latch circuit B 12' latches the eight bits of the digital image signal latched by the latch circuit A 11' at the timing of a latch pulse signal LP. A decoder circuit 16' decodes two medium bits latched by the latch circuit B 12', and a PWM circuit 18 performs pulse width modulation on the basis of three high-order bits latched by the latch circuit B 12'. A level shifter circuit 19' raises the voltage levels of a decoder output signal from the decoder circuit 16' and a PWM signal from the PWM circuit 18. A first switching circuit A 21*a* selectively outputs one of four series of standard multi-ramp waves RAMP1 to RAMP4 whose voltages change in steps with the passage of time depending on the decoder output signal input from the decoder circuit 16' through the level shifter circuit 19'. A second switching circuit A 22*a* selects a voltage, changing in the form of steps, of the standard multi-ramp waves selectively output from the first witching circuit A 21*a* on a time axis depending on the pulse width of a PWM signal input from the PWM circuit 18 through the level shifter circuit 19. The digital driver circuit according to the second embodiment further comprises an SC-DAC circuit 25 which increases and decreases the voltage selected by the second switching circuit A 22*a* depending on the value of three low-order bits input through the level shifter circuit 19' to output the voltage as a drive signal to a signal line. To the digital driver circuit, plural series of reference multi-ramp waves REF1 to REF4 corresponding to the multi-ramp waves RAMP1 to RAMP4 and used as reference when the voltage is increased and decreased by the SC-DAC circuit 25 are input. The digital driver circuit further comprises a first switching circuit B 21*b* that selectively outputs one of the reference multi-ramp waves REF1 to REF4 depending on a decoder output signal input from the decoder circuit 16' through the level shifter circuit 19', and a second switching circuit B 22*b* that selects a voltage, changing in the form of steps, of the reference multi-ramp waves selectively output from the second switching circuit B 22*b* on a time axis depending on the pulse width of a PWM signal input from the PWM circuit 18 through the level shifter circuit 19'. In the second embodiment, the SC-DAC circuit 25 is an example voltage change circuit that changes the voltage selected by the second switching circuit A 22*a* depending on the value of three low-order bits.

Referring to FIG. 7, 8-bit digital image signals D0 to D7 (it is assumed that D0 and D7 denote a low-order bit and a high-order bit, respectively), PWM basic clocks $PCL2^0$, $PCL2^1$, and $PCL2^2$, the four series of standard multi-ramp waves RAMP1 to RAMP4, and the four series of reference multi-ramp waves REF1 to REF4 are input to the digital driver circuit.

The latch circuit A 11' includes a plurality of latch units A0 to A7 corresponding to respective bits of the digital image signals D0 to D7 and each including a transmission gate and an inverter. Transfer signals from the shift register circuit 10' are sequentially input to the latch units A0 to A7. The latch circuit A 11' is formed to latch the digital image signals D0 to D5 at the timings of the transfer signals.

The latch circuit B 12' includes a plurality of latch units B0 to B7 corresponding to respective bits of the digital image signals D0 to D7 and each including a transmission gate and an inverter. A latch pulse LP is input to the latch units B0 to B7. The latch circuit B 12' latches digital image signals D0 to D7 from the latch circuit A 11' at the timing of the latch pulse signal LP.

The 2-bit decoder circuit 16' decodes two medium bits (D3, D4) of the digital image signals D0 to D7. The first switching circuit A 21*a*, which includes a plurality of thin film transistors, selectively supplies one of the standard multi-ramp waves RAMP1 to RAMP4 to the input terminal of the second switching circuit A 22*a* depending on the 2-bit decoder output signals. In this example, the decoder circuit 16' and the first switching circuit A 21*a* for a series selection circuit. The first switching circuit B 21*b* formed in the same manner as that of the first switching circuit A 21*a* selectively supplies one of the reference multi-ramp waves REF1 to REF4 to the input terminal of the second switching circuit B 22*b* depending on the 2-bit decoder output signal.

The second switching circuit A 22*a*, which includes a plurality of thin film transistors, is formed such that the voltage of standard multi-ramp waves supplied through the first switching circuit A 21*a* is selectively supplied to a standard voltage terminal of the SC-DAC circuit 25 depending on the pulse widths of 3-bit PWM signals. In this example, the PWM circuit 18 and the second switching circuit A 22*a* form a time selection circuit. The second switching circuit B 22*b* formed in the same manner as that of the second switching circuit A 22*a* is formed such that the voltage of reference multi-ramp waves supplied through the first switching circuit B 21*b* is selectively supplied to a reference voltage terminal of the SC-DAC circuit 25 depending on the pulse widths of 3-bit PWM signals.

The SC-DAC circuit 25 includes three capacitors having a capacitor ratio of 4C: 2C: 1C. Each capacitor is reset such that a reset TFT 25*a* is rendered conductive by a reset signal RS3 and an inversion signal thereof. When the reset signal RS3 is set at a low level, the reset TFT 25*a* is rendered non-conductive, and the voltage of reference multi-ramp waves selectively supplied from the second switching circuit B 22*b* is accumulated in each capacitor. A switching TFT 25*b* is rendered conductive depending on the value of three low-order bits input through the level shifter circuit 19', and the voltage accumulated in each capacitor is added to standard multi-ramp waves selectively supplied from the second switching circuit A 22*a*.

The level shifter circuit 19' raises the voltage levels of a PWM signal and a decoder output signal each having a power supply voltage of, e.g., 5 V, to 12 V.

Examples of the waveforms of the standard multi-ramp waves RAMP1 to RAMP4 and the reference multi-ramp waves REF1 to REF4 corresponding thereto are shown in FIG. 8. For convenience, FIG. 8 includes graphs showing the voltages of multi-ramp waves corresponding to time units T0 to T3.

In the examples in FIG. 8, the reference multi-ramp waves are respectively set to be higher than the voltages of the corresponding standard multi-ramp waves such that the voltages of the corresponding standard multi-ramp waves can be raised by voltage-addition type charge sharing in the SC-DAC circuit 25.

The operation of the embodiment arranged as described above will be described below with reference to the timing chart in FIG. 9.

Referring to FIG. 9, as in case of the first embodiment described with reference to FIG. 4, in one first-half period, the voltage of the standard multi-ramp wave RAMP1 in the time unit T4 is output from the second switching circuit A 22*a*, and, in one second-half period, the voltage of the standard multi-ramp wave RAMP1 in a time unit T2 is output from the second switching circuit A 22*a* At the same time, in one first-half period, the voltage of the reference multi-ramp waves in the time unit T4 is output from the second switching circuit B 22*b*, and in one second-half period, the voltage of the reference multi-ramp waves in the time unit T2 is output from the second switching circuit B 22*b*.

In the second embodiment, in particular, three low-order bits are input to the SC-DAC circuit 25 through the level shifter circuit 19' at the timing of a reset signal RS2. In a period in which the reset signal RS3 is set at a low level, the voltages accumulated in the capacitors of the SC-DAC circuit 25 are added to the standard multi-ramp waves output from the second switching circuit A 22*a* by charge sharing depending on the value of the three low-order bits. More specifically, in case of charge sharing, in the capacitors of the SC-DAC circuit 25, opposing electrode sides are shifted by "Vref−Vcenter" (Vref: the voltage of a selected reference multi-ramp wave REF) with connection performed by a switch (TFT), thereby adding the voltage to the standard multi-ramp wave RAMP.

As described above, in the second embodiment, for 8-bit digital image signals, a voltage is selected on a time axis depending on the three high-order bits, a series of standard multi-ramp waves is selected depending on the two medium bits, and a voltage selected depending on the three low-order bits is finely adjusted. For this reason, the second embodiment is effective from the viewpoint that multi-gradation is realized with low power consumption and high drive performance, In the embodiment, since only fine adjustment of the drive signal is performed by the SC-DAC circuit 25, the limit of drive performance can be considerably increased in comparison with the prior art in which all gradation levels are realized by using an SC-DAC circuit. Therefore, the embodiment is suitable as a digital driver circuit to be built in a liquid-crystal panel which generally has a limited size and has limited space for forming an excessively large capacitor therein.

In the embodiment, in particular, charge sharing using a plurality of capacitors is performed by the SC-DAC circuit 25 depending on the value of three low-order bits on the basis of a selected voltage in selected standard multi-ramp waves and a selected voltage in selected reference multi-ramp waves. Therefore, a voltage between the voltage of the standard multi-ramp waves and the voltage of the reference multi-ramp waves corresponding to the standard multi-ramp waves can be output by charge sharing.

A digital drive circuit according to the third embodiment of the present invention will be described below with reference to FIG. 10 and FIG. 11. FIG. 10 is a block diagram of the digital driver circuit according to the third embodiment. FIG. 11 is a timing chart of various signals in the third embodiment. The same reference numerals in the second embodiment shown in FIG. 7 and FIG. 9 denote the same constituent elements and the same signals in FIG. 10 to FIG. 11, and a description thereof will be omitted.

Referring to FIG. 10, the digital driver circuit of the third embodiment is different from that of the second embodiment in that an inversion circuit 26 is arranged to invert three low-order bits output from a latch circuit B 12'. The other arrangement of the third embodiment is the same as that of the second embodiment.

The SC-DAC circuit 25 performs voltage subtraction by charge sharing using reference multi-ramp waves depending on the value of the inverted three low-order bits. As shown in FIG. 11, the other operation is the same as that in the second embodiment.

Therefore, voltages between the voltages of standard multi-ramp waves RAMP1 to RAMP4 and the voltages of reference multi-ramp waves REF1 to REF4, which are respectively lower than the voltages of the standard multi-ramp waves at the same time, can be output by voltage subtraction. In this manner, according to this embodiment, the voltages of the reference multi-ramp waves REF1 to REF4 can be set to be lower than those of the multi-ramp waves RAMP1 to RAMP4, the reference multi-ramp waves in the digital driver circuit can be easily handled, and an amplifier having low performance can be advantageously used to generate the reference multi-ramp waves REF1 to REF4.

A digital drive circuit according to the fourth embodiment of the present invention will be described below with reference to FIG. 12 and FIG. 13. FIG. 12 is a circuit diagram of the digital driver circuit according to the fourth embodiment. FIG. 13 is a timing chart of various signals in the fourth embodiment. The same reference numerals in the second embodiment shown in FIG. 7 and FIG. 9 denote the same constituent elements and the same signals in FIG. 12 to FIG. 13, and a description thereof will be omitted.

Referring to FIG. 12, the digital driver circuit of the fourth embodiment is different from that of the second embodiment in the following point. An SC-DAC circuit 25' includes a switching circuit 25*d* for selectively supplying a power supply Vcenter 25*c* and three capacitors by a reset signal RS3 and an inversion signal RS3' thereof, and a switching circuit 25*e* for selectively supplying selected reference multi-ramp waves to three capacitors by the reset signal RS3 and the inversion signal RS3' thereof The SC-DAC circuit 25' is formed such that a difference between the potential of the selected reference multi-ramp wave REF and a potential Vcenter is added to the potential of a selected standard multi-ramp wave RAMP by using a selected capacitor, i.e., charge pumping is performed.

When charge pumping is to be performed as described above, as shown in FIG. 13, although the waveform of the reference multi-ramp wave REF has a large voltage at a position where the difference between gradation voltages is large, a voltage amplitude smaller than that in case of driving by charge sharing may be used This is because, in the SC-DAC circuit 25', when charge pumping is performed, a large voltage can be added by a small capacitor. For this reason, in case of the SC-DAC circuit 25', although the number of elements or the like slightly increases, the capacitors can be reduced in size, so that an area occupied by the whole circuit can be reduced.

Although the SC-DAC circuit 25', as shown in FIG. 12 and FIG. 13, performs the charge pumping depending on the value of three low-order bits, the other operation is the same as that of the second embodiment.

Here, a multi-ramp wave generation circuit for supplying standard multi-ramp waves to the digital driver circuit according to each of the embodiments described above will be described below with reference to FIG. 14.

Referring to FIG. 14, a multi-ramp wave generation circuit 50 comprises a plurality of memories 51, a plurality of 10-bit DAC (digital/analog converter) circuit 52, and a plurality of output amplifier circuits 53. The memories 51 store discrete voltage values for regulating a series of RAMP waveforms. The 10-bit DAC circuits 52 output analog data according to the voltage values stored in the memories 51. Although the output amplifier circuits 53 amplify analog data output from the 10-bit DAC circuits 52, the output amplifier circuits 53 are formed such that multi-ramp waves are generated in response to changes of input voltages to the output amplifier circuits 53. In this manner, in the multi-ramp wave generation circuit 50, a through rate is dependent on the performance of the output amplifier circuits 53, and the 10-bit DAC circuits 52 may supply only voltage values to the output amplifier circuits 53.

As described above, complex control need not be performed, and the output amplifier circuit 53 may have a low through rate and low output power. For this reason, the multi-ramp wave generation circuit 50 can be constituted by a very simple circuit as a whole, and is very advantageous in practical use. In this case, in particular, when the accuracy of a constant voltage (saturation voltage) which is achieved in each ramp wave included in the multi-ramp waves is set, multi-ramp waves having any waveform can be used. For this reason, a through rate can be set to be small as possible within a range in which constant voltage can be obtained, and power consumption can also be decreased to the limit.

According to the embodiment, step-form changes in voltages in the series of standard multi-ramp waves as described above are changes which increase in steps over a relatively long time period. On the other hand, a drive signal is generated by using a constant voltage which is achieved after a ramp wave rises without using a voltage generated at the leading edge of the ramp wave. For this reason, even if the ramp wave moderately rises, when the accuracy of a constant voltage achieved is high, drive performance can be realized with low power consumption by using standard multi-ramp waves output from the output amplifier circuits 53, even if the through rates of the output amplifier circuits 53 are low or have low accuracies.

The multi-ramp wave generation circuit arranged as described above may be externally connected to a digital driver circuit or built therein. A multi-ramp wave generation circuit for generating reference multi-ramp waves is formed in the same manner as described above. When parameters stored in the memories are changed, reference multi-ramp waves having voltages which higher or lower than those of standard multi-ramp waves can be generated.

The multi-ramp wave generation circuit arranged as described above may be formed such that γ-correction of digital image signals for a liquid-crystal panel is performed by adjusting the voltages of plural series of standard multi-ramp waves, respectively. In this case, step changes in voltages in the series of standard multi-ramp waves are changes which increase in steps over a relatively long time period. For this reason, accuracies required for the timings of standard multi-ramp waves can be low. In the embodiment in which drive signals are generated by using constant voltages which are achieved after ramp waves rise without using voltages generated at the leading edges of ramp waves, sharp rising characteristics with respect to the ramp waves are not necessary. For this reason, by using a multi-ramp wave generation circuit having a relatively low through rate or a low accuracy of the through rate, γ-correction can be performed at high accuracy while power consumption is kept low and drive performance is improved.

In each of the embodiments described above, selection on a time axis is performed depending on a plurality of high-order bits, a series of standard multi-ramp waves is selected depending on a plurality of medium or low-order bits, and, in addition to this, a voltage is changed by an SC-DAC depending on a plurality of low-order bits. However, the numbers of high-order, low-order, and medium bits are not limited to the embodiments, and the numbers may be arbitrarily set and properly changed depending on the specifications of devices.

The embodiments according to the present invention described above will be compared with a digital driver circuit including the conventional serial dividedvoltage resistor circuit (to be referred to as a "comparative example 1" hereinafter) disclosed in Japanese Unexamined Patent Publication No. 9-54309 and a digital driver circuit (to be referred to as a "comparative example 2" hereinafter) in which all gradation voltages are obtained by the conventional SC-DAC circuit.

About sixteen large-size TFTs are required in portions of the embodiments of the invention described above, but about forty-eight TFTs are required in comparative example 1. This is because a source-drain resistance in a TFT connected to a resistor must be decreased. Therefore, the increase in number of large-size TFTs makes a circuit area large. In comparative example 2, such large-size TFTs are not required.

In comparative example 1, a resistor consisting of polysilicon must be arranged. In case of the embodiment or comparative example 2, such a resistor is not required. On the other hand, in comparative example 2, wiring for charging or resetting a large number of capacitors is required, and a circuit area is increased. When a large-capacity capacitor for improving drive performance is included, the circuit size further increases. For this reason, comparative example 2 is limited to driving a liquid-crystal panel having a size of about 5" in diagonal length. In contrast to this, in case of the embodiment or comparative example 1, a large-size liquid-crystal panel or the like can be driven.

In consideration of a vertical size, when a circuit pitch is 0.15 mm, the digital driver circuit of the embodiment can be micropattemed to be about 3 mm in height. In contrast to this, in comparative example 1, the vertical size is about 6 to 7 mm. In comparative example 2, the digital driver circuit can be micropattemed to be about 4.2 mm in vertical size.

Finally, in consideration of power consumption, to achieve the same drive performance, in comparative example 1, power consumption in the resistor is high, so that the power consumption of the circuit as a whole is also high. In the embodiment or comparative example 2, power consumption is low.

As described above, it is understood that the digital driver circuit of the embodiment is excellent from the viewpoints of drive performance, power consumption, and circuit area.

Embodiments of liquid-crystal devices serving as examples of electro-optical devices in which digital driver circuits according to the embodiments described above are built will be described below with reference to FIG. 15, FIG. 16, and FIG. 17.

An embodiment of a liquid-crystal device shown in FIG. 15 comprises a liquid crystal held between a pair of substrates. Pixel electrodes 40 for applying voltages to liquid crystals in pixels arranged in the form of a matrix are arranged on a TFT array substrate 100 serving as one substrate. Drive signals from signal lines 41 are supplied as data signals to the pixel electrodes 40 through the sources and drains of TFTs 30 respectively arranged on the pixels. Scanning signals are supplied from the signal lines 41 to the gates of the TFTs 30.

In the embodiment in FIG. 15, a signal line drive circuit 101 has one shift register circuit 10 and a number of digital driver circuits 200 equal to that of the signal lines 41. Each of the digital driver circuits 200 is the same as the digital driver circuit (see FIG. 2) according to the first embodiment described above, so that the signal lines 41 are driven. Wirings for standard multi-ramp waves RAMP1 to RAMP8 are commonly connected to all the digital driver circuits 200. For this reason, an amplifier for outputting these multi-ramp waves requires voltage supply performance for saturating the voltages of the plurality of signal lines 41. However, since plural series of step-form multi-ramp waves are used as described above, time margins which are sufficient to electrically saturate the signal lines 41 with multi-ramp waves can be obtained.

The signal line drive circuit 101 is formed on the TFT array substrate 100. As described above, each of the digital driver circuits 200 can be micropatterned to be about 3 mm in vertical size, even if the pixel pitch is 0.15 mm.

Another embodiment of a liquid-crystal device shown in FIG. 16 has a number of digital driver circuits 200' equal to the number of signal lines 41 and each of the digital driver circuits 200' is the same as one of the digital driver circuit (see FIG. 7, FIG. 10, and FIG. 12) according to the second to fourth embodiments. Wirings for multi-ramp waves RAMP1 to RAMP4 and reference multi-ramp waves REF1 to REF4 are commonly connected to all of the digital driver circuits 200'. Other portions of the liquid-crystal device in FIG. 16 are the same as that in the embodiment in FIG. 15.

Still another embodiment of a liquid-crystal device shown in FIG. 17 comprises digital driver circuits 200A(lower) and 200B (upper) formed such that the digital driver circuits 200A and 200B are each one half of the digital driver circuit (see FIG. 2) according to the first embodiment described above. More specifically, a lower signal line drive circuit 101A has a shift resistor circuit 10A and a number of digital driver circuits 200A equal to that of even-numbered (numbers X2, X4, . . . , X2*n*) signal lines 41 and which are divided as described above, so that the even-numbered signal lines 41 are driven. An upper signal line drive circuit 101B has one shift register circuit 10B and a number of digital driver circuits 200B equal to that of odd-numbered (numbers X1, X3, . . . , X2*n*−1) signal lines 41, so that the odd-numbered signal lines 41 are driven. For this reason, each of the numbers of bits of the digital driver circuits 200A and 200B is set to be ½ (i.e., m/2 bits) the number of bits (i.e., m bits) of the digital driver circuit 200 according to the first embodiment.

In addition, in the liquid-crystal device according to the embodiment, a check circuit for performing predetermined types of electric characteristic checks during manufacturing of the liquid-crystal device or after the liquid-crystal device is manufactured is vertically divided by two, and the divided check circuits are arranged as a check circuit 210B and a check circuit 210A on the lower side and the upper side, respectively. Each of the check circuits 210A and 210B includes a plurality of analog switches 211, e.g., TFTs and or the like, and a plurality of switch opening/closing control circuits 212, e.g., TFTs or the like. When opening (disconnection), shortcircuit, or the like is checked through the even-numbered signal lines 41, application of a predetermined voltage or measurement of a current is performed at checking terminals ANGoutT, ToutT, and TinT connected to the upper check circuit 210A. On the other hand, when checking is performed through the odd-numbered signal lines 41, application of a predetermined voltage or measurement of a current is performed at checking terminals ANGoutB, ToutB, and TinB connected to the lower check circuit 210B.

Referring to FIG. 17, capacitive lines 43 are arranged along the scanning lines 42 every pixel row for adding an accumulated capacity to the liquid-crystal pixels. However, in the embodiments of the liquid-crystal devices shown in FIGS. 15 and 16, capacitive lines (not shown) are not arranged in the same manner as described above.

The liquid-crystal device according to the embodiment has a compact arrangement as a whole since the check and driver circuits are vertically divided. More specifically, since the digital driver circuit or the check circuit is divided, the number of elements included in each circuit is ½ that of a complete circuit. Therefore, in comparison with a case wherein these divided circuits are formed as one circuit, areas occupied by the circuits are respectively reduced, the elements can be arranged or wired with margins of the respective circuits.

In particular, with respect to an electro-optical panel, such as an liquid-crystal panel that has an image display region formed at the center and peripheral regions formed above and below the image display region, elements can be arranged or wired with well-balanced margins formed in the upper and lower peripheral regions.

The division performed as described above makes it possible to uniformly arrange circuits, and dead spaces on the device substrate can be effectively used. For example, in the case of a liquid-crystal panel, a dead space located immediately below a sealing material for sealing a liquid crystal between both of a pair of substrates adhered to each other can be practically used. More specifically, since the sealing material is formed to be in contact with the peripheries of the substrates with uniform widths such that excessive stress does not act on the substrates, the numbers of elements in the circuits are reduced by dividing the circuits, and the circuits may be uniformly arranged in the region located immediately below the sealing material.

In an electro-optical panel of this type, a pitch of circuit elements in one direction along a scanning line is especially limited.

Since the size of the check circuit is smaller than the element size of the digital driver circuit, further space saving can be achieved by dividing the check circuit, and an advantage on layout design can be obtained.

In addition, since the number of stages of the shift registers 10A and 10B is half of that in the first embodiment, an operation frequency also becomes ½, and an advantage in circuit design can be obtained.

In FIG. 17, when the phases of upper multi-ramp waves RAMP1T to 8T and the phases of lower multi-ramp waves RAMP1B to 8B are shifted from each other by 180°, dot inversion drive can be performed. For this reason, flicker or the like of a display image can be prevented, and the liquid crystal can also be prevented from being degraded by applying a DC voltage.

According to the embodiments of the liquid-crystal devices shown in FIGS. 15 to 17, even if the image display regions are increased in size, the liquid-crystal devices can be driven, the ratio of the image display regions to the device bodies can be increased, and power consumption can be lowered. In addition, γ-correction can also be accurately performed by adjusting the voltage values of multi-ramp waves.

Each of the embodiments of the liquid-crystal devices shown in FIG. 15 to FIG. 17 is formed as a liquid-crystal device comprising the TFTs 30 as switching elements in respective pixels and using a TFT active matrix drive scheme. However, various switches, logical circuits, and the like (see FIG. 2, FIG. 7, FIG. 10, and FIG. 12) included in the digital driver circuits 200 can be preferably replaced with TFTs. More specifically, various elements can be formed as a whole device by a thin film forming technique, so that an advantage in manufacturing can be obtained.

Embodiments of electronic apparatus including the liquid-crystal devices described above will be described below with reference to FIG. 18 to FIG. 22.

A schematic block diagram of an electronic apparatus including the liquid-crystal device as described above is shown in FIG. 18.

Referring to FIG. 18, the electronic apparatus comprises a display information output source 1000, a display information processing circuit 1002, a display circuit 1004, a liquid-crystal panel 1006, a clock generation circuit 1008, and a power supply circuit 1010. The display information output source 1000 includes a memory, such as a ROM (Read Only Memory), a RAM (Random Access Memory), or an optical disk device and a tuning circuit or the like for tuning a television signal to output the tuned television signal, and outputs display information, such as an image signal having a predetermined format to the display information processing circuit 1002. The display information processing circuit 1002 includes various known processing circuits such as an amplification-polarity inversion circuit, a phase development circuit, a rotation circuit, a gamma-correction circuit, and a clamping circuit, and sequentially generates digital signals from the display information input on the basis of the clock signal to output the digital signals to the display circuit 1004 together with a clock signal CLK. The display circuit 1004 corresponds to the digital driver circuit in each of the embodiments described above to drive the liquid-crystal panel 1006. The power supply circuit 1010 supplies predetermined power signals to the respective circuits described above. The display circuit 1004 may be mounted on a TFT array substrate of the liquid-crystal panel 1006 along with the display information processing circuit 1002.

Examples of the electronic apparatus arranged as described above are shown in FIG. 19 to FIG. 22.

Referring to FIG. 19, a liquid-crystal projector 1100 includes three liquid-crystal modules each including the liquid-crystal panel 1006 having the display circuit 1004 mounted on the TFT array substrate that are part of light values 100R, 100G, and 100B for RGB light. In the liquid-crystal projector 1100, when projection light is emitted from a lamp unit 1102 such as a metal halide lamp, the projection light is divided into light components R, G, and B corresponding to the three primary colors of RGB by three mirrors 1106 and two dichroic mirrors 1108. The light components R, G, and B are guided to the light values 100R, 100G, and 100B corresponding to the colors, respectively. In this case, in particular, B light is guided through a relay lens system 1121, which includes an incident lens 1122, a relay lens 1123, and an emission lens 1124 to prevent light loss caused by a long optical path. The light components corresponding to the three primary colors respectively modulated by the light valves 100R, 100G, and 100B are synthesized with each other by a dichroic prism 1112, and the synthesized light is projected on a screen 1120 through a projection lens 1114 as a color image.

In this embodiment, in particular, when a light-shielding layer is also arranged on the lower side of a TFT, even if part (part of R lightand G light) of the light passing through the liquid-crystal panel and penetrating the dichroic prism 1112 is reflected to the TFT array substrate as return light, light shielding for the channel of a switching TFT or the like of a pixel electrode can be sufficiently performed. In this case, even if a prism suitable for reduction in size is used in the projection optical system between the TFT array substrate and the prism of each liquid-crystal panel, an AR filn for preventing return light need not be adhered, or a polarizing plate need not be subjected to an AR coating process. For this reason, the embodiment is considerably advantageous to achieve a compact and simple arrangement.

Referring to FIG. 20, a multimedia laptop personal computer (PC) 1200 includes the liquid-crystal panel 1006 described above in a top cover case. In addition, the personal computer 1200 includes a main body 1204 which incorporates a CPU, a memory, a MODEM, and the like and in which a keyboard 1202 is built.

Referring to FIG. 21, a pager 1300 includes a liquid-crystal panel 1006 and display circuit 1004 mounted on a TFT array substrate that form a liquid-crystal module incorporated in a metal frame 1302 together with a light guide 1306, backlight 1306*a*, a circuit board 1308, first and second shield plates 1310 and 1312, two elastic conductors 1314 and 1316, and a film carrier tape 1318. In this example, the display information processing circuit 1002 described above (see FIG. 18) may be mounted on the circuit board 1308, or may be mounted on the TFT array substrate of the liquid-crystal panel 1006. In addition, the display circuit 1004 described above can also be mounted on the circuit board 1308.

Since the example shown in FIG. 21 is a pager, the circuit board 1308 and the like are also included. However, when the display circuit 1004 or the display information processing circuit 1002 is also mounted to the liquid crystal panel 1006 to form a liquid-crystal module, a device in which the liquid-crystal panel 1006 is fixed in the metal frame 1302 can also be produced, sold, and used as a liquid-crystal device or a backlight liquid-crystal device in which the light guide 1306 is additionally built.

As shown in FIG. 22, the liquid-crystal panel 1006 does not include the display circuit 1004 or the display information processing circuit 1002. Instead, an IC 1324 including the display circuit 1004 or the display information processing circuit 1002 is physically and electrically connected to a TCP (Tape Carrier Package) 1320 packaged on a polyimide tape 1322 through an anisotropic conductive film formed on a peripheral portion of a TFT array substrate 100. The resultant device can also be produced, sold, or used as a liquid-crystal device.

In addition to the electronic apparatuses described with reference to FIG. 19 to FIG. 22, a liquid-crystal television, a viewfinder type or direct-vision type video cassette recorder monitor, a satellite navigation system, an electronic organizer, a calculator, a wordprocessor, an engineering workstation (EWS), a portable telephone set, a television telephone set, a POS terminal, a device having a touch panel, and the like are used as examples of the electronic apparatus shown in FIG. 18.

As described above, according to the embodiments, various electronic apparatuses comprising large-size liquid-crystal devices having low power consumption can be realized.

According to the digital driver circuit of the present invention, when selection of a series of standard multi-ramp waves and selection of a voltage are combined to each other, drive signals corresponding to the value of digital image signals are generated. For this reason, the accuracies of timings required for the respective standard multi-ramp waves are considerably reduced. In addition, even if an amplifier for supplying the standard multi-ramp waves has low performance, a time margin which is sufficient to saturate a signal line with the voltage of a drive signal can be assured. As a result, according to the digital driver circuit of the present invention, drive performance can be improved by using a circuit having a relatively low through rate while keeping power consumption low, and temperature compensation or γ-correction can be relatively easily performed at a high accuracy.

What is claimed is:

1. A driver circuit for an electro-optical device that receives an n-bit (n is a natural number not less than 2) digital image signal supplied from n bit lines, generates an analog drive signal corresponding to the digital image signal, and outputs the analog drive signal to a signal line comprising:

a series selection circuit that selects at least one series from plural series of standard multi-ramp waves, having voltages that change in steps with a passage of time, according to the n-bit digital image signal; and a time selection circuit that selects a time of at least one of the selected series of standard multi-ramp waves and a wave based on the selected series of standard multi-ramp waves to generate at least one voltage, the time selection circuit having a PWM circuit that generates pulse signals having different pulse widths, and the series selection circuit having a decoder that decodes at least one portion of the digital image signal.

2. A driver circuit for an electro-optical device that receives an n-bit (n is a natural number not less than 2) digital image signal supplied from n bit lines, generates an analog drive signal corresponding to the digital image signal, and outputs the analog drive signal to a signal line comprising:

a series selection circuit that selects at least one series from plural series of standard multi-ramp waves, having voltages that change in steps with a passage of time, according to the n-bit digital image signal;

a time selection circuit that selects a time of at least one of the selected series of standard multi-ramp waves and a wave based on the selected series of standard multi-ramp waves to generate at least one voltage;

a voltage change circuit that changes at least one of the generated voltage and a voltage based on the generated voltage, the voltage change circuit comprising an SC-DAC (Switched Capacitor–Digital to Analog Converter) circuit;

an inversion circuit that inverts a digital value of at least one portion of the digital image signal for input to the SC-DAC circuit, the SC-DAC circuit performing voltage subtraction by charge sharing depending on the inverted portion.

3. A method for driving an electro-optical device, comprising:

selecting at least one series from plural series of standard multi-ramp waves, having voltages that change in steps with a passage of time, according to an n-bit digital image signal; and selecting a time of at least one of the selected series of standard multi-ramp waves and a wave based on the selected series of standard multi-ramp wave to generate at least one voltage; and generating a pulse width modulated signal.

4. A method for driving an electro-optical device, comprising:

selecting at least one series from plural series of standard multi-ramp waves, having voltages that change in steps with a passage of time, according to an n-bit digital image signal;

selecting a time of at least one of the selected series of standard multi-ramp waves and a wave based on the selected series of standard multi-ramp wave to generate at least one voltage;

changing the generated voltage;

inverting a digital value of at least one portion of the digital image signal; and performing voltage subtraction by charge sharing based on the inverted value.

5. A method for driving an electro-optical device, comprising:

selecting at least one series from plural series of standard multi-ramp waves, having voltages that change in steps with a passage of time, according to an n-bit digital image signal;

selecting a time of at least one of the selected series of standard multi-ramp waves and a wave based on the selected series of standard multi-ramp wave to generate at least one voltage;

changing the generated voltage; and performing one of charge sharing and charge pumping using the generated voltage and a selected reference voltage.

6. A driver circuit for an electro-optical device that receives an n-bit (n is a natural number not less than 2) digital image signal supplied from n bit lines, generates an analog drive signal corresponding to the digital image signal, and outputs the analog drive signal to a signal line comprising:

a series selection circuit that selects at least one series from plural series of standard multi-ramp waves, having voltages that change in steps with a passage of time, according to the n-bit digital image signal;

a time selection circuit that selects a time of at least one of the selected series of standard multi-ramp waves and a wave based on the selected series of standard multi-ramp waves to generate at least one voltage;

a voltage change circuit that changes at least one of the generated voltage and a voltage based on the generated voltage, the time selection circuit receiving digital values corresponding to a first bit to an m-th bit ($1 \leqq m < p < n$, m and p are natural numbers), the series selection circuit receiving digital values corresponding to an m+1-th bit to a p-th bit, and the voltage change circuit receiving digital values corresponding to a p+1-th bit to the n-th bit.

* * * * *